US006568439B1

(12) United States Patent
Se et al.

(10) Patent No.: US 6,568,439 B1
(45) Date of Patent: May 27, 2003

(54) CONTAINER CAP AND LIQUID COMMUNICATION ADAPTER

(75) Inventors: Naomi Se, Hiroshima (JP); Takehiko Yuki, Hiroshima (JP); Ryoji Fujii, Hiroshima (JP)

(73) Assignee: JMS Co., Ltd., Hiroshima (JP)

( * ) Notice: Subject to any disclaimer, the term of this patent is extended or adjusted under 35 U.S.C. 154(b) by 0 days.

(21) Appl. No.: 10/009,892

(22) PCT Filed: Apr. 18, 2000

(86) PCT No.: PCT/JP00/02530

§ 371 (c)(1),
(2), (4) Date: Oct. 22, 2001

(87) PCT Pub. No.: WO00/63088

PCT Pub. Date: Oct. 26, 2000

(30) Foreign Application Priority Data

Apr. 20, 1999 (JP) ..... 11-111845
Apr. 22, 1999 (JP) ..... 11-115371

(51) Int. Cl.[7] ..... B65B 1/04

(52) U.S. Cl. ..... 141/301; 141/330; 604/416

(58) Field of Search ..... 141/21–27, 301, 141/302, 329, 330; 604/411–416

(56) References Cited

U.S. PATENT DOCUMENTS 4,834,152 A * 5/1989 Howson et al. ..... 141/286
6,189,580 B1 * 2/2001 Thibault et al. ..... 141/25

FOREIGN PATENT DOCUMENTS

| | | |
|---|---|---|
| EP | 0 499 481 | 8/1992 |
| JP | 2-1275 | 1/1990 |
| JP | WO 90/11103 | 10/1990 |
| JP | 3-504571 | 10/1991 |
| JP | 4-503179 | 6/1992 |
| JP | 5-124664 | 5/1993 |
| JP | 5-168679 | 7/1993 |
| JP | 7-75663 | 3/1995 |
| WO | WO 91/05581 | 5/1991 |

* cited by examiner

*Primary Examiner*—Steve O. Douglas
(74) *Attorney, Agent, or Firm*—Merchant & Gould P.C.

(57) ABSTRACT

A container cap or a liquid communication adapter attachable to a container mouth having a conventional rubber-like stopper. A container cap includes at least one disk-like valve provided with an insertion hole in a central portion thereof, and a cover for restraining the valve by covering at least an upper periphery of the valve. A lower periphery on a back surface of the valve is supported by a seating portion of a container mouth or a seating portion of a joint that is supported by the container mouth, and the container cap has an anchor for anchoring an insertion member to the cap by using a peripheral edge forming a fitting hole in the cover, while inserting the insertion member into the insertion hole.

54 Claims, 16 Drawing Sheets

CONTAINER CAP AND LIQUID COMMUNICATION ADAPTER

TECHNICAL FIELD

The present invention relates to a container cap for a liquid-filled or empty container such as a vial or a bag and a liquid communication adapter attachable to a container mouth. The present invention also relates to a container cap and a liquid communication adapter attachable to a container mouth that are useful for mixing medicine used as a mixture with other medicine or medicine by being dissolved in a solvent immediately before an administration, for example, a powder or lyophilized antineoplastic agent, antibiotic or blood product, with the other liquid medicine or the solvent.

BACKGROUND ART

In general, when stored as a liquid medicine in a container such as a vial or a bag, an antineoplastic agent, antibiotics, a blood product or a lyophilized preparation have a problem of having reduced stability and efficacy. Therefore, in medical institutions such as hospitals, such a medicine conventionally has been dissolved immediately before being used for an instillation treatment. Such an operation conventionally has included filling a solvent etc. in a syringe to which a sharp needle is attached and piercing a rubber-like stopper of the vial etc. with the needle. However, in the case of using the sharp needle, even with great care being taken, users such as nurses sometimes prick themselves accidentally.

Furthermore, when a different type of liquid medicine is mixed/introduced through a three-way valve attached to some point partway along a liquid feed line of an infusion or blood transfusion set while giving an infusion or blood transfusion to a patient, the operation has involved drawing up the liquid medicine from a container such as a vial by a syringe with a needle attached thereto, removing the needle from the syringe and then fit-connecting a luer of the syringe to the three-way valve, which has been complicated. In addition, when the needle is attached to/removed from the syringe, there have been risks of accidental pricks and liquid medicine contamination.

Moreover, when the liquid medicine in the container such as the vial is drawn up with the syringe little by little and over and over again, a part of the rubber-like stopper that is degraded due to the many repeated piercings is removed by an opening at the tip of the needle, thus causing coring. The resulting fragment falls into the contents of the vial so as to contaminate the liquid medicine.

In order to solve these problems, inventive efforts have been made such as connecting a syringe to which a blunt cannula is attached and a vial using a communication tool such as an adapter or a connection tube, thus infusing or drawing up liquid medicine.

For example, JP 3(1991)-504571 A mainly discloses an injection site that supports within a housing a sealing member through which a blunt cannula can be inserted repeatedly.

JP 5(1993)-168679 A mainly discloses an adapter including a collar member engaging a neck of a vial, a cannula piercing a stopper of a container and a female receptor for receiving a male luer of a syringe provided at a distal end of the cannula. The male luer of the syringe is sealed and temporarily held in the female receptor by a rib formed in a circumferential direction in the female receptor and further an annular protrusion (an annular rib) formed at a site contacting a tip of the male luer.

Alternatively, JP 7(1995)-75663 A also discloses a method of using a rubber-like stopper provided with a piercing hole penetrating therethrough in a container mouth. This piercing hole penetrates the rubber-like stopper ark, using a metal needle having a diameter of about 1 mm and is small enough not to be observed easily with the naked eye from the surface. This piercing hole is closed because of the self-sealing characteristics of the rubber when a cannula is not piercing, while the surface of the piercing hole is in close contact with a circumference of the cannula because of the self-sealing characteristics of the rubber when the cannula is piercing.

However, the method disclosed in JP 3-504571 A requires a cannula exclusively for the insertion through the sealing member. Also, there is no description that a commonly used syringe can be used. Thus, a problem may arise in that a mixing/introducing operation is not possible with respect to an infusion or blood transfusion set having a three-way valve as a mixing/introducing port.

Also, in JP 5-168679 A, although a commonly used syringe can be used, there is a problem in air-tightness between the male luer of the syringe and the female receptor. In particular, when dissolving powder preparations, there are some cases where liquid medicine is filled in or taken out of the pierced syringe or the container such as the vial is inclined, raising a chance of liquid leakage during the operation. In addition, because of its concave shape, the female receptor is difficult to sterilize, raising the possibility of developing an insanitary condition.

Furthermore, JP 7-75663 A does not seem to be suitable for repeated uses. This is because the many repeated piercings of a cannula having a diameter of about 3 to 4 mm through the piercing hole having a diameter of about 1 mm generates a crack in some portion of the circumference of the piercing hole. If this piercing is repeated further, a gap is generated between the cannula and the rubber-like stopper, then the liquid may leak from this gap. Moreover, although this method is suitable for inserting a spike having a relatively sharp tip, it is not suitable for an insertion member such as a syringe luer having a flat end face at its tip. The reason is that a piercing resistance during the insertion is large and that the above-described crack of the rubber-like stopper is likely to occur. In addition, although the self-sealing characteristics of the rubber can bring the stopper described above into close contact with the circumference of the cannula, it is impossible to hold the inserted cannula stably so as not to move in a loose manner.

In order to solve the problems described above, it is an object of the present invention to provide a container cap or a liquid communication adapter, in which many repeated piercings do not cause degradation in a rubber-like stopper of a vial, that can be engaged with a luer of a commonly used syringe, reliably can keep air-tightness with the syringe luer when the luer is connected, reliably can prevent liquid leakage when the luer is not connected, and further can allow an easy and reliable sterilization of a piercing site.

DISCLOSURE OF INVENTION

In order to solve the problems described above, a container cap according to the present invention includes at least one disk-like valve provided with an insertion hole in a central portion thereof, and a cover for restraining the valve by covering at least an upper periphery of the valve. A lower periphery on a back surface of the valve is supported by a seating portion of a container mouth or a seating portion of a joint that is supported by the container mouth, and the container cap has an anchor means for anchoring an insertion member to the cap by using a peripheral edge forming a fitting hole in the cover, when inserting the insertion member into the insertion hole.

With this configuration, it is possible to carry out the above-described operations of preparing medicine without using a sharp needle at all. Also, even many repeated piercings do not cause degradation in a rubber-like stopper of a vial, thus reducing a possibility of liquid medicine contamination because of coring.

Furthermore, when drawing liquid medicine into a commonly used syringe and then mixing/introducing this liquid medicine into a blood circuit or an infusion or blood transfusion set to which a three-way valve or a mixing/introducing port capable of receiving an insertion member such as the commonly used syringe luer is attached, it is possible to perform a series of operations without using a sharp needle at all. Accordingly, the needle used for drawing up the liquid medicine etc. becomes unnecessary, thus reducing costs. Also, because the needle does not need to be attached/removed before the mixing/introducing, the operation is simplified. Furthermore, it is possible to reduce the possibility of accidental pricks and liquid medicine contamination, which have accompanied when the needle is attached to/removed from the syringe.

Moreover, since the structure is relatively simple, there is an advantage of reduced percent defective products and less failure in products.

Also, in the container cap according to the present invention, either the combination of the cover and the seating of the container mouth or that of the cover and the seating provided in the joint may restrain the disk-like valve. However, when it is difficult to form the container mouth functioning to restrain the valve in cooperation with the cover and the container mouth is formed of a material incapable of achieving sufficient dimensional accuracy to keep a sufficient liquid tightness, it is desirable to provide the joint made of an easily-moldable material, so as to restrain the valve by the seating of the joint and the cover.

In addition, in the container cap according to the present invention, it is preferable that the joint has a supported portion that is supported by the container mouth. This is because, although the joint may be supported by a supporting portion provided in the container main body, when the container is a conventional container, for example, a vial, the use of the joint having the supported portion that can be supported by the conventional container makes it possible to use this container cap for the conventional container.

Also, it is preferable that the container cap according to the present invention has an anchor means to the container mouth on an inner surface at a lower end of a side portion of the cover. This makes it possible to fasten the container cap main body and the container mouth reliably, and to reduce the possibility that an adhesive or the like is eluted into liquid medicine to be infused or collected because a solvent such as the adhesive is not needed for the fastening.

Furthermore, the container cap according to the present invention may have at least one notch in the side portion of the cover. This allows an easy attachment of the cover.

Moreover, in the container cap according to the present invention, the cover may have at least two leg portions, whose lower ends are provided with an anchor means to the container mouth. This allows an easy attachment of the cover.

Also, it is preferable that the container cap according to the present invention further includes an annular rib that is formed annularly along an upper peripheral edge of the joint forming a hole provided in an upper portion of the joint. Even when the insertion of the insertion member into the container cap has deformed the valve, it is possible to prevent liquid leakage between the valve and the seating and to improve valve reclosing characteristics and valve recovering performance from a downward deflection at the time of removing the insertion member.

Also, it is preferable that the container cap according to the present invention further includes an O-ring between the joint and the container mouth. This can keep air-tightness in a more preferred manner.

In the container cap according to the present invention, it is preferable that the anchor means is a circular fitting hole formed at a center of the cover and anchors the insertion member by the peripheral edge forming the fitting hole in the cover. This makes it possible to anchor the insertion member easily without using any anchor means having a special mechanism. Also, since the insertion member can be anchored while penetrating the disk valve, it becomes possible not only to infuse liquid but also to collect the liquid.

Furthermore, in the container cap according to the present invention, it is preferable that the fitting hole has a diameter of 3.9 to 4.4 mm, and the cover forming the fitting hole has a thickness of 0.3 to 1.0 mm in a portion contacting the insertion member. The values outside this range make it difficult to anchor the insertion member and pose problems in wiping off the liquid and sterilization because of an increased space between the fitting hole and the valve.

Moreover, in the container cap according to the present invention, it is preferable that an annular groove is formed on a thin portion of the disk-like valve, for example, a front surface of the disk-like valve. Since the valve can be extended more easily based on the annular groove by the insertion of the insertion member such as the luer, along with the annular rib described above, a portion compressing the disk-like valve and a portion to be extended by the insertion of the insertion member such as the luer can be considered divided, thereby achieving both the air-tightness and the operability/reclosing characteristics at the same time.

In addition, in the container cap according to the present invention, it is preferable that an annular hook engaging with the annular groove formed on the front surface of the disk-like valve is formed in a restraining portion of the cover. This is because, when the annular groove is formed on the surface, it is necessary to prevent the liquid medicine from accumulating in this groove.

Also, in the container cap according to the present invention, it is preferable that the insertion hole is a linear slit having a length L0 of 2.5 to 4.5 mm. The slit shorter than 2.5 mm makes it difficult to insert the insertion member, while that longer than 4.5 mm may cause leakage of the liquid medicine from both ends of the slit during the insertion of the insertion member. It is further preferable that the length L0 of the slit is 3.0 to 4.0 mm. The values within this range allow a smooth insertion of the insertion member and eliminate the possibility of the leakage of the liquid medicine from both ends of the slit during the insertion or removal of the insertion member.

The outer circumferential shape of the disk valve can be circular, elliptical or polygonal.

Also, in the container cap according to the present invention, it is preferable that a ratio of an outer diameter D2 of the valve to the length L0 of the slit is $1.1 \leqq D2/L0$. The value smaller than 1.1 may present risks of deformation and damage/breakage of the valve by the insertion of the insertion member.

Furthermore, in the container cap according to the present invention, it is preferable that the valve has a thickness of 1.0 to 2.0 mm. This is because, in order to insert the insertion member more easily, the disk valve preferably should be thin to the extent that the liquid leakage is not caused. In particular, it is more preferable that the valve has a thickness of 1.0 to 2.0 mm in a portion of the insertion hole.

Moreover, in the container cap according to the present invention, it is preferable that the valve is formed of an elastic material having a JIS-A hardness of 20 to 55.

In the container cap according to the present invention, it is preferable that a material for the valve is selected from the group consisting of a silicone rubber, a natural rubber, a synthetic rubber and a thermoplastic elastomer. By selecting such materials, it becomes easier to retain properties such as air-tightness, insertion characteristics and reclosing characteristics.

Also, in the container cap according to the present invention, when the material for the valve is selected from the group consisting of the silicone rubber, the natural rubber and the synthetic rubber, a film preferably is arranged somewhere from a position that may rupture by the insertion of the insertion member to the back surface of the valve. This makes it possible to prevent additives from eluting because of the contact of the back surface of the valve with the liquid medicine in the container main body when the liquid medicine is stored. The material for this film preferably is polyethylene or polypropylene that has heat resistance and chemical resistance.

In addition, this film preferably has a mechanical property in which the insertion of the insertion member easily can rupture the film but does not cause a ruptured fragment to fall in. This can prevent the ruptured fragment from falling so as to contaminate the liquid medicine.

Furthermore, as other means for preventing elution of the additives caused by the contact of the back surface of the valve with the liquid medicine in the container main body, the back surface of the valve may be coated with a resin such as polyethylene or polypropylene.

Also, in order to prevent the surface of the container cap from being contaminated until immediately before drawing or infusing the liquid, the container cap according to the present invention preferably is provided with a protective member coating at least a portion exposed to the outside of the valve. Such a protective member may be, for example, a cap to be attached to the container cap, an aluminum foil coated with a plastic, namely, a tamper seal fused or affixed onto an upper surface of the container cap or a pull-ring that can be cut and separated from a cover provided on an upper surface of the cover of the container cap.

Moreover, in the container cap according to the present invention, it is preferable that at least two protrusions are provided in a periphery of a side surface of the cover, and the container cap has an anchor means for anchoring the insertion member by a cylindrical lock adapter whose bottom is provided with notches engaging with the protrusions, that has the insertion member inserted and restrained therethrough and inserts the insertion member into the insertion hole and rotates the bottom, thereby engaging the notches provided at the bottom with the protrusions of the cover. This makes it possible to use even an insertion member that cannot be inserted directly into the container cap, for example, a luer of a luer lock syringe.

Next, in order to achieve the above-mentioned object, a liquid communication adapter according to the present invention at least includes a cannula for piercing a stopper of a container, and at least one disk-like valve placed at a proximal end of the cannula and provided with an insertion hole in a central portion thereof. An insertion member extending inward through the valve and the container are in a liquid communication with each other. The liquid communication adapter includes a seating for supporting a lower periphery on a back surface of the valve, and a cover for restraining the valve covering at least an upper periphery of the valve, and has an anchor means for anchoring the insertion member to the adapter by using a peripheral edge forming a fitting hole in the cover, when inserting the insertion member into the insertion hole.

With this configuration, when using a commonly used syringe, and drawing liquid medicine into the syringe and then mixing/introducing this liquid medicine into a blood circuit or an infusion or blood transfusion set to which a three-way valve or a mixing/introducing port capable of receiving an insertion member such as the commonly used syringe luer is attached, it becomes possible to perform a series of operations without using a sharp needle at all. Accordingly, the needle used for drawing up the liquid medicine etc. becomes unnecessary, thus reducing costs. Also, because the needle does not need to be removed before the mixing/introducing, the operation is simplified. Furthermore, it is possible to reduce the possibility of accidental pricks and liquid medicine contamination, which have accompanied the needle being attached to/removed from the syringe. In addition, it is possible to carry out the above-described operations of preparing medicine without using a sharp needle at all. Also, even many repeated piercings do not cause degradation in a rubber-like stopper of a vial, thus reducing a possibility of liquid medicine contamination because of coring.

Moreover, since the structure is relatively simple, there also is an advantage of reduced percent defective products and less failure in products.

In addition, in the liquid communication adapter according to the present invention, it is preferable that at least two protrusions are formed on a side surface of the proximal end of the cannula, and at least two notches engaging with the protrusions are formed on the cover. This makes it possible to fasten the liquid communication adapter main body and the cover reliably, and to reduce the possibility that an adhesive or the like is eluted into the liquid to be infused or collected because a solvent such as the adhesive is not used for the fastening.

Also, it is preferable that the liquid communication adapter according to the present invention further includes an annular rib that is formed annularly along an upper peripheral edge of the seating forming a hole provided in the seating. Even when the insertion of the insertion member into the liquid communication adapter has deformed the valve, it is possible to prevent liquid leakage between the valve and the seating and to improve valve reclosing characteristics and valve recovering performance from a downward deflection at the time of removing the insertion member.

Furthermore, in the liquid communication adapter according to the present invention, it is preferable that the anchor means is a circular fitting hole formed at a center of the cover and anchors the insertion member by the peripheral edge forming the fitting hole in the cover. This makes it possible to anchor the insertion member easily without using any anchor means having a special mechanism. When medicine is prepared by filling a solvent into a vacuum vial containing a powder preparation, for example, a syringe can be left standing by using this anchor means because it is supported upright and does not lean. While left standing, the solvent in the syringe is drawn into the vial by a negative pressure therein, and therefore, it is possible to prepare a plurality of medicines in the meantime. Also, since the insertion member can be anchored while penetrating the disk valve, it becomes possible not only to infuse liquid but also to collect the liquid.

Moreover, in the liquid communication adapter according to the present invention, it is preferable that a filter is provided in a lower portion of the seating. This can prevent impurities such as a dust adhering to the surface from entering into the liquid medicine.

Furthermore, in the liquid communication adapter according to the present invention, it is preferable that the fitting hole has a diameter of 3.9 to 4.4 mm, and the cover forming the fitting hole has a thickness of 0.3 to 1.0 mm in a portion contacting the insertion member. The values outside this range make it difficult to anchor the insertion member and pose problems in wiping off the liquid and sterilization because of an increased space between the fitting hole and the valve.

Moreover, in the liquid communication adapter according to the present invention, it is preferable that an annular groove is formed on a thin portion of the disk-like valve, for example, a front surface of the disk-like valve. Since the valve can be extended more easily based on the annular groove by the insertion of the insertion member such as the luer, along with the annular rib described above, a portion compressing the disk-like valve and a portion to be extended by the insertion of the insertion member such as the luer can be considered divided, thereby achieving both the air-tightness and the operability/reclosing characteristics at the same time.

In addition, in the liquid communication adapter according to the present invention, it is preferable that an annular hook engaging with the annular groove formed on the front surface of the valve is formed in a restraining portion of the cover. This is because, when the annular groove is formed on the surface, it is necessary to prevent the liquid medicine from accumulating in this groove.

Also, in the liquid communication adapter according to the present invention, it is preferable that the insertion hole is a linear slit having a length L0 of 2.5 to 4.5 mm. The slit shorter than 2.5 mm makes it difficult to insert the insertion member, while that longer than 4.5 mm may cause leakage of the liquid medicine from both ends of the slit during the insertion of the insertion member. It is further preferable that the length L0 of the slit is 3.0 to 4.0 mm. The values within this range allow a smooth insertion of the insertion member and eliminate the possibility of the leakage of the liquid medicine from both ends of the slit during the insertion/removal of the insertion member.

The outer circumferential shape of the disk valve can be circular, elliptical or polygonal.

Also, in the liquid communication adapter according to the present invention, it is preferable that a ratio of an outer diameter D2 of the valve to the length L0 of the slit is $1.1 \leqq D2/L0$. The value smaller than 1.1 may present risks of deformation, damage/breakage of the valve by the insertion of the insertion member.

Furthermore, in the liquid communication adapter according to the present invention, it is preferable that the valve has a thickness of 1.0 to 2.0 mm. This is because, in order to insert the insertion member easily, the disk valve preferably should be thin to the extent that the liquid leakage is not caused. In particular, it is more preferable that the valve has a thickness of 1.0 to 2.0 mm in a portion of the insertion hole. Moreover, it is further desirable that the valve is formed of an elastic material having a JIS-A hardness of 20 to 55.

Also, in the liquid communication adapter according to the present invention, it is preferable that when the insertion member is fitted through the valve, a maximum inserted depth $D_{max}$, an inserted depth D, a valve thickness L1 and a thickness L2 in a portion contacting the insertion member in the cover forming the fitting hole satisfy a relationship of $(L1+L2) \leqq D \leqq D_{max}$. This makes it possible to both infuse and collect liquid as well as hold the insertion member reliably.

In the liquid communication adapter according to the present invention, it is preferable that a material for the valve is selected from the group consisting of a silicone rubber, a natural rubber, a synthetic rubber and a thermoplastic elastomer. By selecting such materials, it becomes easier to keep functions such as air-tightness, insertion characteristics and reclosing characteristics.

Moreover, in the liquid communication adapter according to the present invention, it is preferable that at least two protrusions are provided in a periphery of a side surface of the cover, and the liquid communication adapter has an anchor means for anchoring the insertion member by a cylindrical lock adapter whose bottom is provided with notches engaging with the protrusions, that has the insertion member inserted and restrained therethrough and inserts the insertion member into the insertion hole and rotates the bottom, thereby engaging the notches provided at the bottom with the protrusions of the cover. This makes it possible to use even an insertion member that cannot be inserted directly into the container cap, for example, a luer of a luer lock syringe.

BEST MODE FOR CARRYING OUT THE INVENTION

First, a container cap according to an embodiment of the present invention includes a valve for mainly opening/closing a flow channel, a cover for restraining the valve and an anchor means that is provided in the cover so as to anchor an insertion member such as a syringe luer. In the following, each of these elements will be described.

Figure 1:
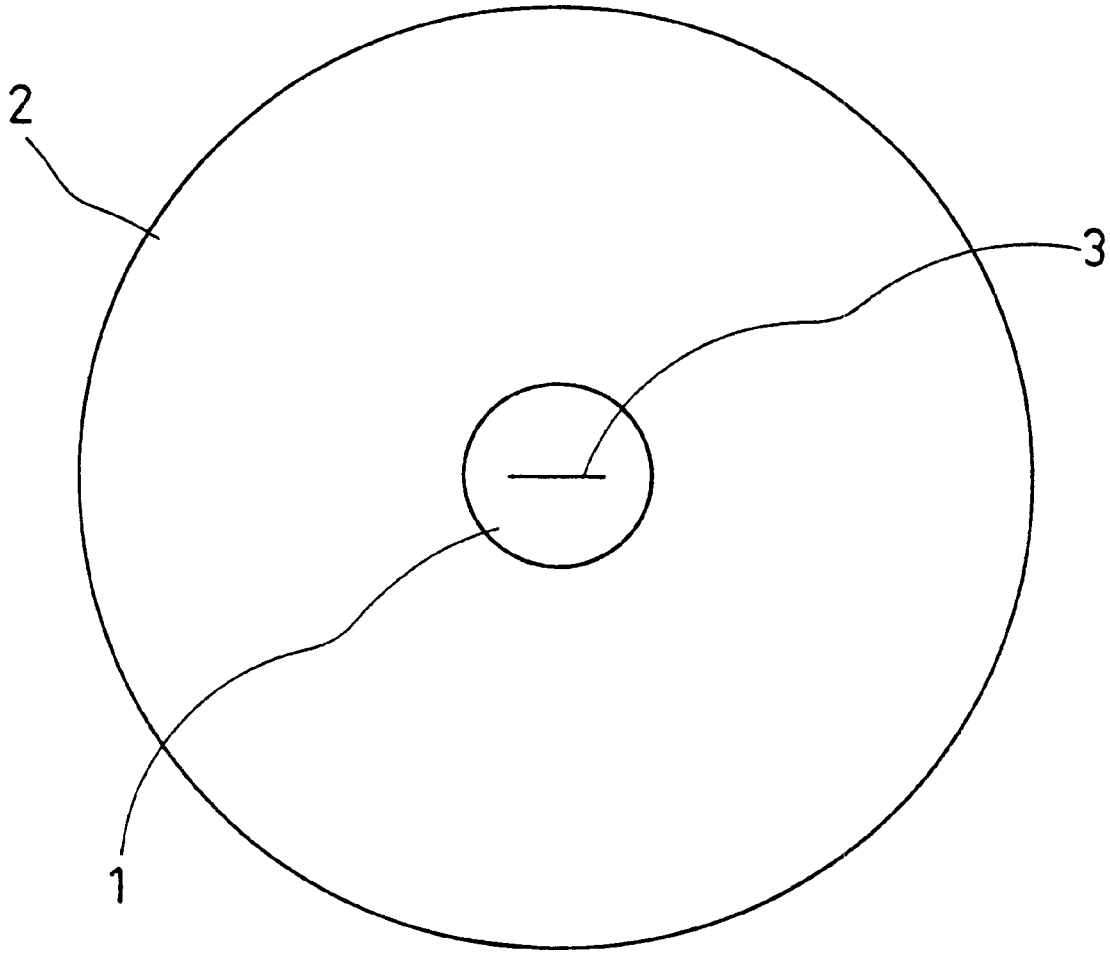
FIG. 1 is a plan view showing a container cap according to an embodiment of the present invention.
Figure 2:
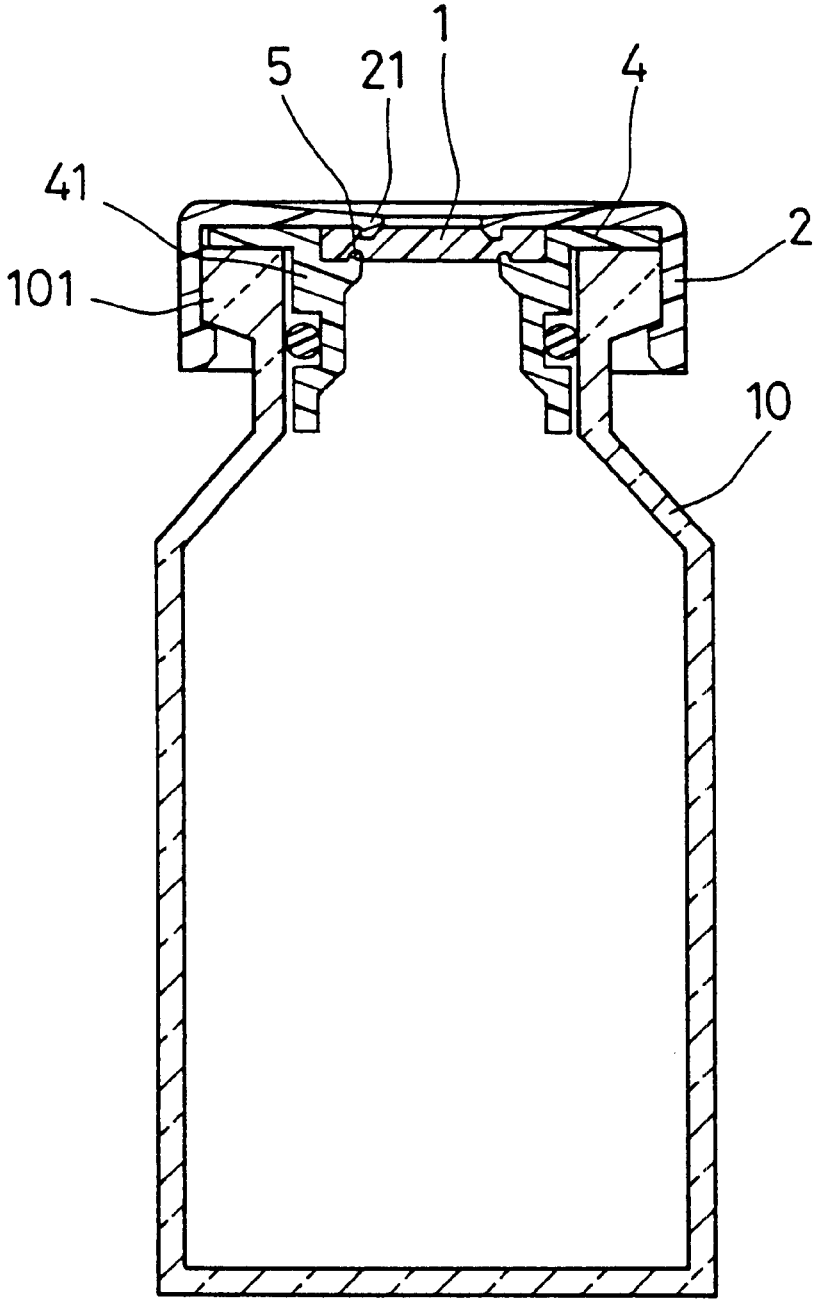
FIG. 2 is a sectional side view showing the container cap and a container to which the cap is attached according to an embodiment of the present invention.

The cover is not specifically limited as long as it firmly can hold (restrain) the valve when the insertion member is inserted in/removed from the valve. For example, as shown in FIG. 1 or 2, when a cover 2 is formed so as to cover at least an upper periphery of a valve 1 with a central portion of a front surface of the valve 1 left uncovered (open), an insertion site for the insertion member easily can be found and an accidental contact can be prevented from contaminating the valve surface. It also is more effective to provide a front surface of the cover 2 with a gentle taper (inclination).

The profile of an opening of a container main body associated with the container cap according to an embodiment of the present invention is not specifically limited as long as the opening restrains the valve in cooperation with the cover and has a shape corresponding to that of the cover so as to function as such. However, under the cover 2 or the valve 1, the opening preferably has a seating portion for supporting a lower periphery of the valve 1 with the central portion of a back surface thereof left free. This makes it possible to restrain the valve 1 reliably by the upper and lower peripheries within a container mouth. However, when it is difficult to form the seating portion in the opening of the container main body, for example, when the container main body is made of glass, it is preferable that a joint made of an easily-moldable synthetic resin having a seating portion similar to the above is sandwiched between the container main body and the cover. When considering heat resistance and chemical resistance, the material for the joint preferably is polyacetal, polypropylene, polyamide, polyethylene terephthalate, polybutylene terephthalate or polycarbonate. In addition, when an annular rib 5 is formed annularly along a periphery of a hole provided in a seating portion 41 of a joint 4 as shown in FIG. 2, liquid leakage between the valve 1 and the seating portion 41 can be prevented even with deformation of the valve 1 because of the insertion of the insertion member into the container mouth.

The anchor means is not specifically limited as long as it has a simple Ad structure so as to anchor the insertion member such as the syringe luer to the container cap. For example, it can be a round fitting hole 7 formed at the center of the cover 2, which is formed to have shape and dimension allowing the fitting hole 7 to fit the insertion member such as the luer engageably. Such a configuration makes it possible to anchor the insertion member reliably with a simple structure.

When the insertion member is a syringe tip having a general luer shape, it is preferable that the dimension of the fitting hole 7 is 3.9 to 4.4 mm in diameter and 0.3 to 1.0 mm in thickness. It also is preferable that the cover 2 is strong enough not to crack even when fitting the insertion member firmly into the fitting hole 7. When considering chemical resistance and heat resistance, the material therefor can be polyacetal, polypropylene, polyamide, polyethylene terephthalate, polybutylene terephthalate or polycarbonate.

The valve 1 is appropriate as long as it allows easy insertion and removal of the insertion member and can be opened reliably. For example, it can be a disk-like valve 1 having a flat surface. If the disk-like valve 1 has a bowl-shaped surface, the insertion member can be inserted easily and cannot be removed accidentally. Furthermore, there is an advantage that the liquid leakage from the insertion hole can be suppressed when the insertion member is removed. However, there is a practical disadvantage that a liquid remains on the disk-like valve 1 and that the remaining liquid is difficult to wipe off.

Moreover, a circular or an elliptical profile of the valve 1 is appropriate for molding the container mouth. It is convenient when an insertion hole 3 of the valve 1 is formed to be a linear slit. When the insertion member has a luer shape of the general syringe as described above, it is preferable that the length L0 of the slit is 2.5 to 4.5 mm from the viewpoint of insertion characteristics of the valve and liquid tightness. It also is preferable that the ratio of an outer diameter D2 of the valve 1 to the slit length L0 is $1.1 \leqq D2/L0$ for the reason described below. It is preferable that the valve 1 has a thickness of 1 to 2 mm from the viewpoint of the insertion characteristics and non-return effect of the valve and cost effectiveness. The material for the valve 1 may be any rubber-like elastic materials, and more specifically, it preferably is one having a JIS-A hardness of 20 to 55. The specific material can be a silicone rubber, a natural rubber, a synthetic rubber such as a butyl rubber and a nitrile rubber, or a thermoplastic elastomer.

The following is a description of a container cap according to an embodiment of the present invention, with reference to the accompanying drawings. FIG. 1 is a plan view showing the container cap according to an embodiment of the present invention, and FIG. 2 is a sectional side view showing the container cap and a container to which the cap is attached according to an embodiment of the present invention. In FIGS. 1 and 2, numeral 1 denotes a disk-like valve, numeral 2 denotes a cover, numeral 3 denotes an insertion hole, numeral 4 denotes a joint, numeral 5 denotes an annular rib, and numeral 10 denotes a container main body.

Figure 3A:
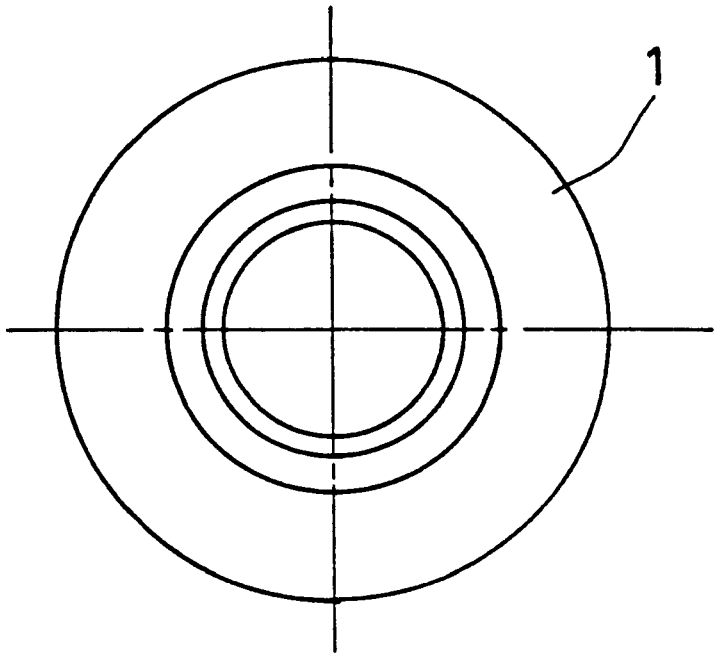
FIG. 3A is a plan view showing a valve in the container cap according to an embodiment of the present invention.
Figure 3B:
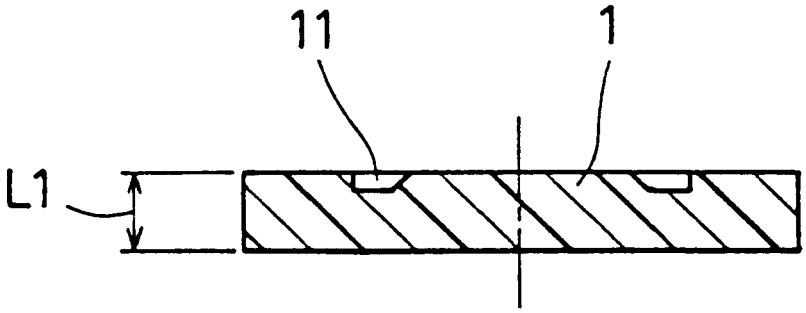
FIG. 3B is a sectional view showing the valve in the container cap according to an embodiment of the present invention.

As shown in FIG. 3, the valve 1 has a flat surface and an annular groove 11 on the front surface thereof Since it is fastened by the cover 2 and the annular rib 5, the disk-like valve 1 can be considered divided into a compressed portion and a portion to be extended by an insertion of an insertion member such as a luer.

In other words, when the insertion member is inserted into the disk-like valve 1, an inner portion of the disk-like valve 1 with respect to the annular rib 5 is extended, while an outer portion thereof with respect to the annular rib 5 is held at a predetermined position. When the annular rib 5 is not provided, the compression for keeping air-tightness of a peripheral holding portion of the valve 1 prevents the valve 1 from recovering its initial shape after the insertion member is removed, and thus the insertion hole 3 does not recover its initial shape, which brings about a downward deflection (warp) of the valve. When the downward deflection cannot return to a normal state, this may lead to contamination, liquid residue and a problem in air-tightness. However, by providing the annular rib 5 so as to divide the extended portion and the compressed portion, it is possible to keep a conventional air-tightness in the compressed portion. At the same time, in the extended portion, the valve 1 easily can recover its initial shape, making it possible to return to the normal state.

In addition, by forming the annular groove on the front surface of the valve, the insertion of the insertion member such as the luer can extend the valve easily based on this groove, making it easier to insert the insertion member, leading to an increased operability.

Furthermore, since the insertion member can be inserted while being guided by the annular rib 5, it becomes possible to improve the ease of insertion and fitting characteristics of the insertion member.

The insertion hole 3 has a slit-like shape consisting of one straight line in the present embodiment. However, it is not specifically limited to the above shape, but may have a slit-like shape consisting of, for example, three straight lines crossing at the center.

Figure 4A:
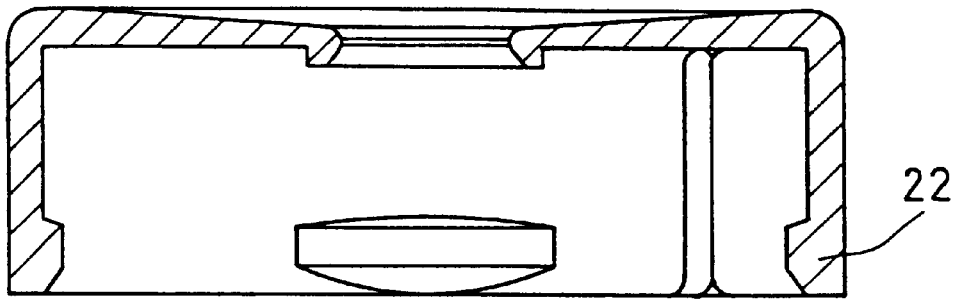
FIG. 4A is a sectional side view showing a cover in the container cap according to an embodiment of the present invention.
Figure 4B:
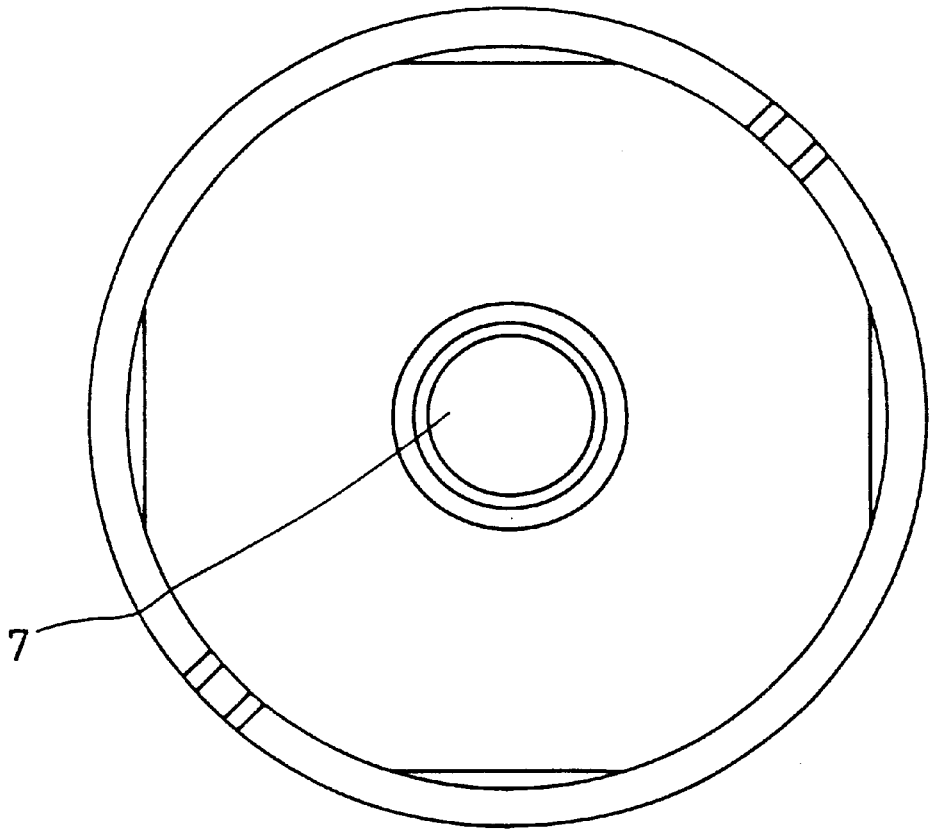
FIG. 4B is a bottom view showing the cover in the container cap according to an embodiment of the present invention.
Figure 5:
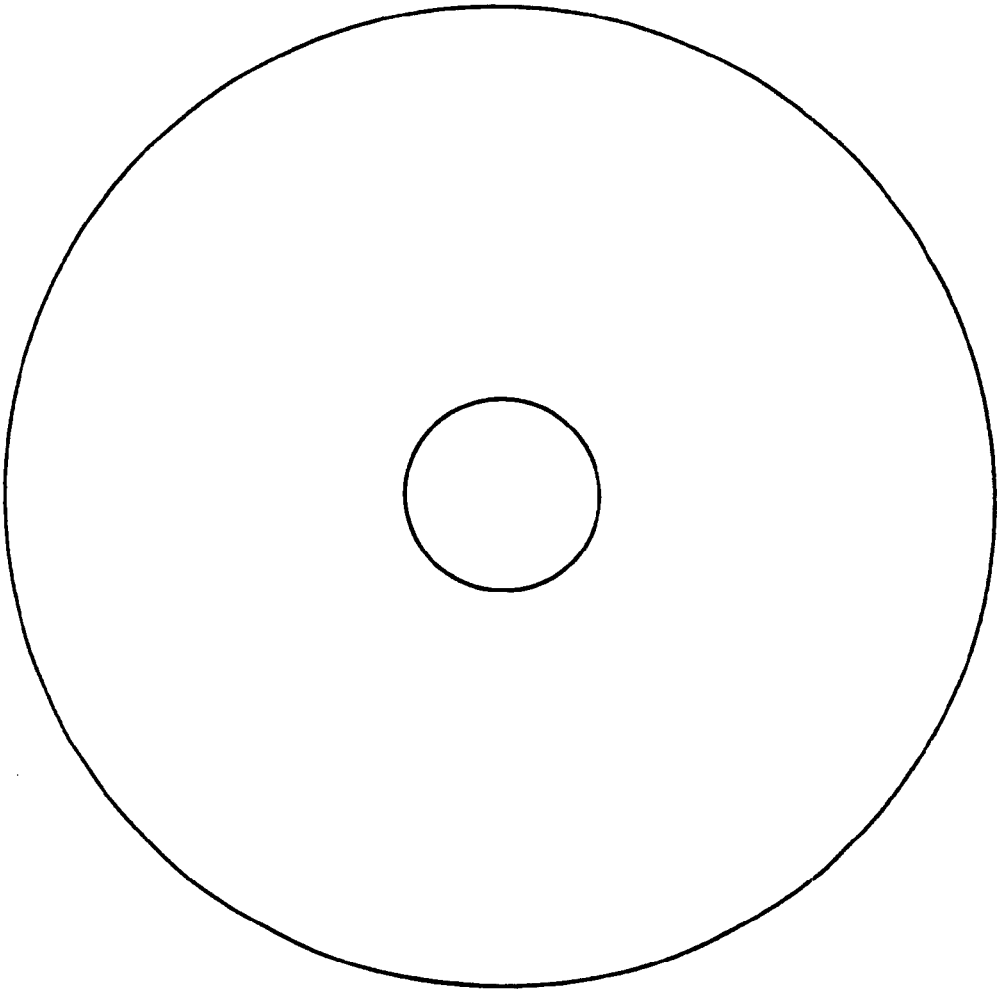
FIG. 5 is a plan view showing the cover in the container cap according to an embodiment of the present invention.

FIG. 4A is a sectional side view showing the cover 2 in the container cap according to the present embodiment, FIG. 4B is a plan view from below showing the cover 2 in the container cap according to the present embodiment, and FIG. 5 is a plan view from above showing the cover 2 in the container cap according to the present embodiment.

The cover 2 has the fitting hole 7 at the center as shown in FIG. 4B, and has a gentle taper (inclination) toward the fitting hole 7 as shown in FIG. 4A. As shown in FIG. 4A, in order to fasten the cover 2 easily to the mouth of the container main body 10, a lower end of an outer side portion of the cover 2 is provided with at least two protrusions 22, which engage with a projection 101 provided in the periphery of the mouth of the container main body 10 shown in FIG. 2.

Although the circumference of the cover 2 is circular in the present embodiment, it also may be elliptical as the valve shape, or polygonal.

By covering and restraining the upper periphery of the valve 1 with the cover 2 with the central portion thereof left uncovered, it is possible to reduce a surface area of the insertion hole of the container mouth to be exposed. This can reduce considerably the chance of entry of impurities into liquid medicine in the container and infection with bacteria floating in the outside air.

Moreover, this cover 2 firmly can hold the insertion member in the container mouth. For example, in the central portion of the cover, the insertion member can be fitted and held firmly in the circular fitting hole 7 that has a diameter equal to or slightly smaller than that of the insertion member. When medicine is prepared by filling a solvent into a vacuum vial containing a powder preparation, a syringe can be left standing because it is supported upright by the fitting hole 7 and does not lean. While left standing, the solvent in the syringe is drawn into the vial by a negative pressure therein, and therefore, it is possible to prepare a plurality of medicines in the meantime.

The fitting hole 7 preferably has a diameter of 3.9 to 4.4 mm and a thickness of 0.3 to 1.0 mm so as to agree with a standard luer, and it more preferably has a diameter of 3.9 to 4.2 mm and a thickness of 0.5 to 0.7 mm. Also, the fitting hole 7 may be tapered so as to correspond to a tapered luer of the above-described insertion member.

The material for the cover 2 has to have a hardness suitable for holding the valve 1 and the insertion member tightly. In particular, the cover 2 desirably has a suitable hardness and is formed of a material that is not easily damaged so that the insertion member easily can be inserted into the fitting hole 7 (an excessive hardness reduces tolerance for receiving the insertion member) and fitted securely. For example, polyamide, polyethylene terephthalate, polybutylene terephthalate and polycarbonate are desirable in addition to polyacetal and polypropylene.

Figure 6:
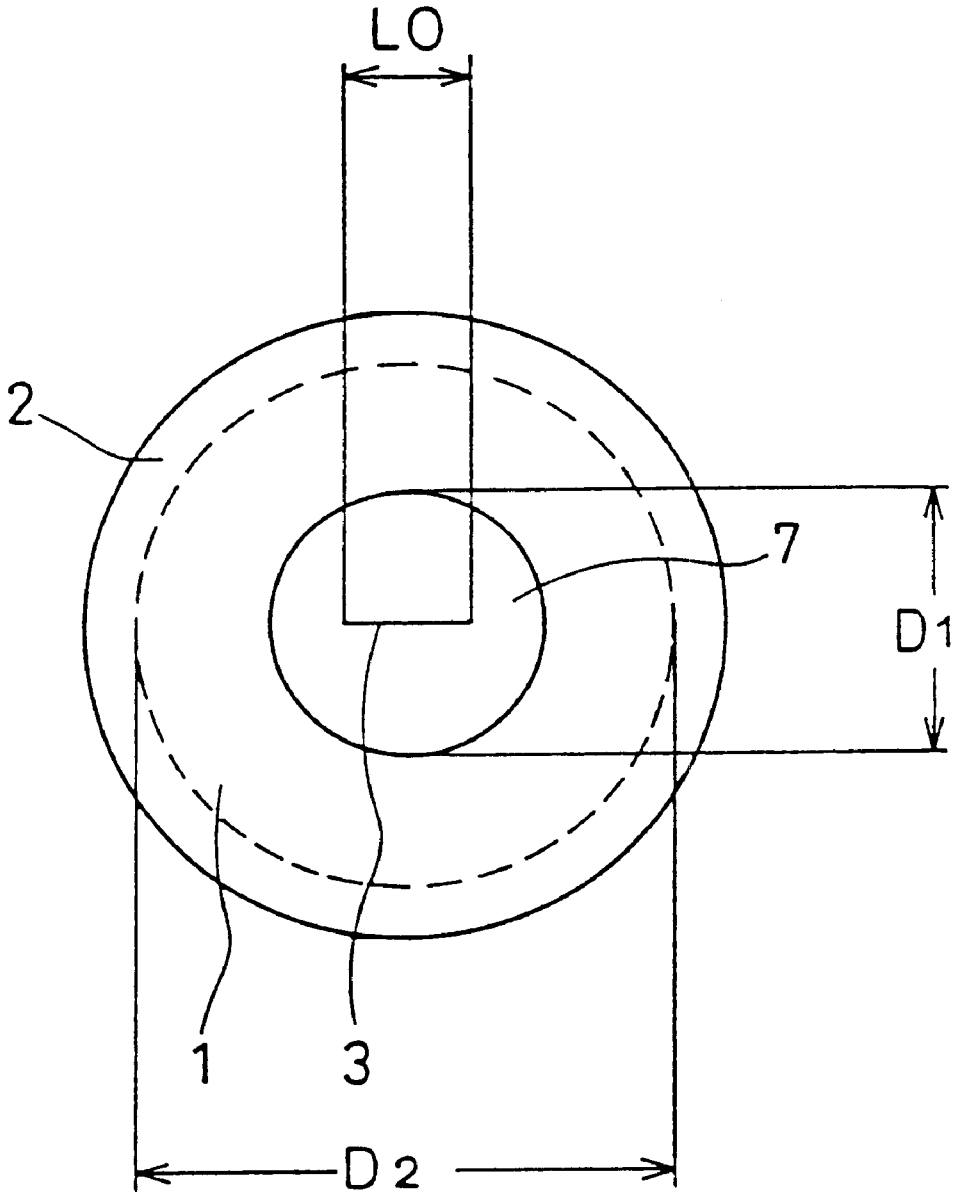
FIG. 6 is a drawing for describing the valve in the container cap according to an embodiment of the present invention.

As shown in FIG. 6, D1 represents a diameter of the fitting hole 7, D2 represents an outer diameter of the disk-like valve 1, and L0 represents a length of the slit of the insertion hole 3. In this case, it is preferable that $1.1 \leqq D2/L0$ is satisfied from the viewpoint of the insertion characteristics and non-return effect of the valve 1. This is because, if the length L0 of the insertion hole 3 is larger than the outer diameter D2 of the valve, namely, D2/L0 is smaller than 1.1, the insertion into the valve may cause valve deformation or damage (breakage) or reduce the outer portion of the valve with respect to the annular rib 5, so that the valve falls off from the seating at the time of the insertion.

Regarding the length L0 of the slit serving as the insertion hole and the insertion member, when the insertion member is inserted into the slit, the diameter of the insertion member that is buried into the valve 1 is called an inserted portion diameter here. In this case, it is preferable that the slit length L0 is 0.5 to 1.1 times as large as the inserted portion diameter. This is because the insertion of the insertion member is difficult when L0 is shorter, while the insertion of the insertion member into the container mouth is more likely to cause liquid leakage from the insertion hole when L0 is larger.

Furthermore, the diameter A inside a seating 8 preferably is small from the viewpoint of resealing, but has to be large enough to receive the insertion member until the insertion member is anchored tightly by the fitting hole 7. In other words, it has to be larger than the diameter of the insertion member itself and large enough to secure a space in which the valve 1 can yield downward to a pressure. When the insertion member is the syringe luer, the diameter A inside the seating 8 preferably is 5.0 to 7.0 mm.

Furthermore, it is preferable that the valve 1 shown in FIG. 3 has a thickness L1 of 1 to 2 mm from the viewpoint of the insertion characteristics and non-return effect of the valve and cost effectiveness. The material for the valve 1 may be any general rubber-like elastic material, and more CM specifically, it preferably is the one having a JIS-A hardness of 20 to 55. The specific material can be a silicone rubber, a natural rubber, a synthetic rubber such as a butyl rubber and a nitrile rubber, or a thermoplastic elastomer.

Moreover, as shown in FIG. 2, the joint 4 has the seating portion 41 for supporting the lower periphery with the central portion of the back surface of the valve left free. By providing this seating portion 41, it becomes possible to restrain the valve 1 firmly by the container cap. The seating portion 41 is formed annularly so as to correspond to the shape of the valve 1.

Also, the cover 2 is provided with an annular hook 21, which engages with the annular groove formed on the front surface of the valve 1 in an inner portion with respect to the periphery of the valve on the seating portion 41, thereby preventing liquid medicine, which may leak from the slit at the time of removing the insertion member, from accumulating in the annular groove even when the insertion of the insertion member into the container cap has deformed the valve 1.

Figure 7A:
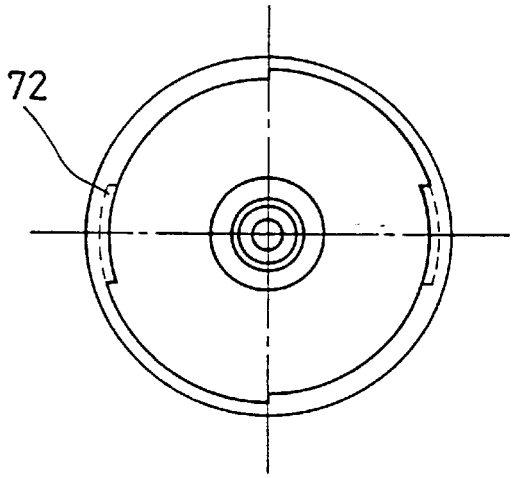
FIG. 7A is a bottom view showing a lock adapter in the container cap according to an embodiment of the present invention.
Figure 7C:
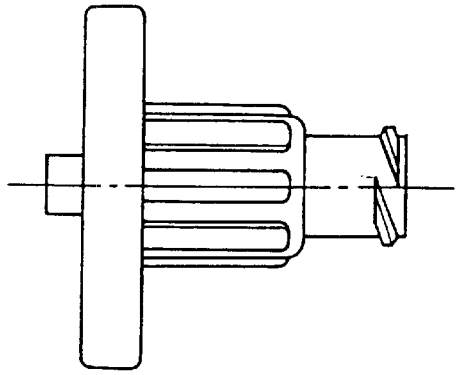
FIG. 7C is a side view showing the lock adapter in the container cap according to an embodiment of the present invention.
Figure 7B:
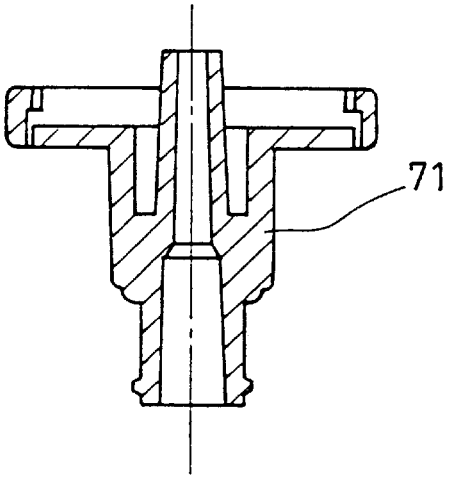
FIG. 7B is a sectional side view showing the lock adapter in the container cap according to an embodiment of the present invention.

Furthermore, in order to anchor the insertion member more reliably, it also is effective to use a lock adapter as shown in FIG. 7. In FIG. 7, FIG. 7A is a plan view showing the lock adapter, FIG. 7B is a sectional side view showing the lock adapter, and FIG. 7C is a side view showing the lock adapter.

As shown in FIG. 7, the lock adapter is fastened to the cover 2 using notches 72 provided in a lower portion of a lock adapter cap cover 71.

Figure 8:
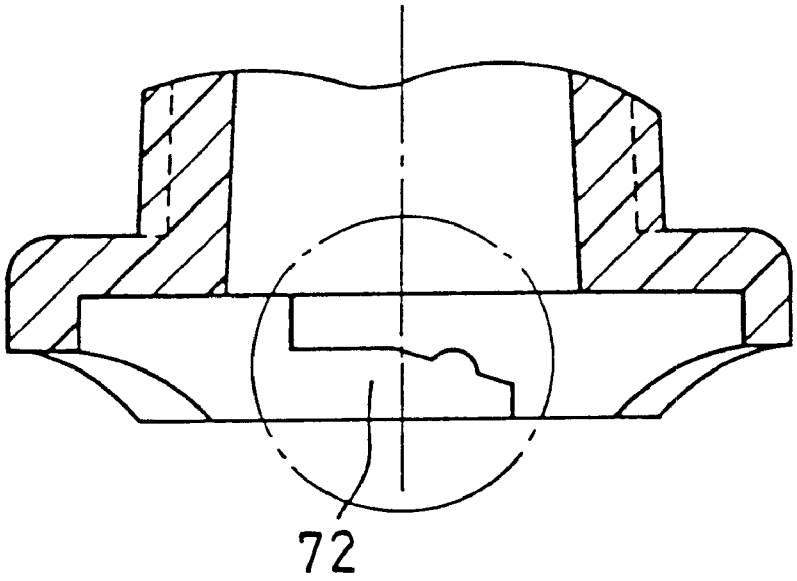
FIG. 8 is an enlarged sectional view showing a lower portion of the lock adapter in the container cap according to an embodiment of the present invention.
Figure 9A:
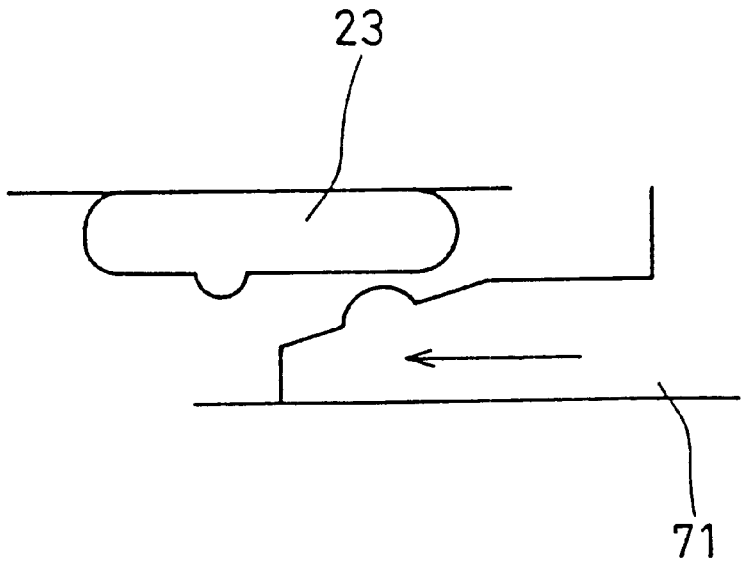
FIG. 9A is a drawing for describing a state before connecting a lock adapter cap cover.
Figure 9B:
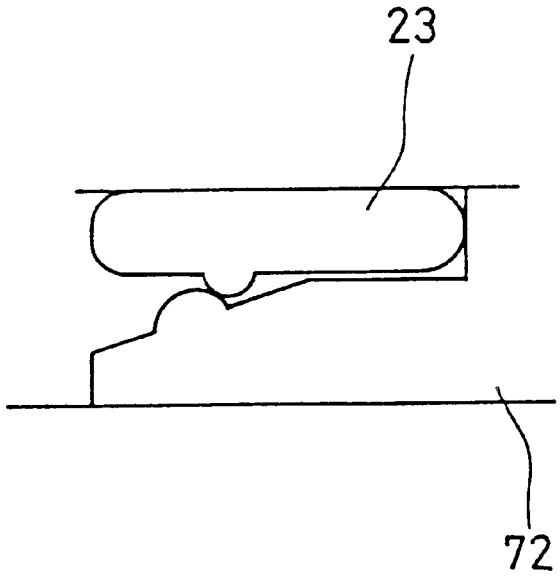
FIG. 9B is a drawing for describing a state after connecting the lock adapter cap cover.

In other words, referring to FIG. 8, which is an enlarged sectional view showing the lower portion of the lock adapter cap cover 71, the notches 72 for being rotated into an engagement are provided on an inner side of the lock adapter cap cover 71. The lock adapter cap cover 71 is fitted so that these notches 72 and protrusions 23 formed on a periphery of the cover fit together (see FIG. 9A), and further is rotated into the engagement as shown in FIG. 9B, thereby achieving a reliable fastening.

The following is a description directed to the case where the container mouth has a conventional shape, namely, is not provided with the above-described container cap. In this case, a conventional rubber-like stopper often is used, and thus, many repetitions of inserting/removing of the needles inevitably cause coring. Accordingly, it may be possible to use a communication adapter, wherein a cannula or the like is pierced through the rubber-like stopper only one time and thereafter a luer or the like can be used as the insertion member as in the cap described above.

Thus, a cannula of a liquid communication adapter according to an embodiment of the present invention includes a site piercing a stopper of a container and a proximal end opposite to a tip of the piercing portion. Although the piercing portion may be similar to a needle portion of a conventionally known spike and is not limited specifically, it is preferable that the tip thereof is closed so as not to cause coring and a side wall of the cannula has an opening.

Also, the liquid communication adapter according to an embodiment of the present invention preferably has a means for fixing itself to the container. The fixing means may be a collar member that covers the container mouth partially or entirely and engages with the container. This collar member reliably fixes the liquid communication adapter according to an embodiment of the present invention to the container and is provided with a gripping space (a gripping means) sufficient for inserting the adapter manually into the container so as to make it easier to attach this adapter to the container while preventing an accidental contact with a finger or the like from contaminating a valve surface. Other gripping means may be the cover as described above or a plate-like flange that extends symmetrically from the proximal end of the cannula.

The liquid communication adapter according to an embodiment of the present invention includes a valve for mainly opening/closing a flow channel, the cannula piercing the stopper of the container, a cover for restraining the valve in cooperation with the proximal end of the cannula and an anchor means that is provided in the cover so as to anchor an insertion member such as a syringe luer. In the following, each of these elements will be described.

Figure 10:
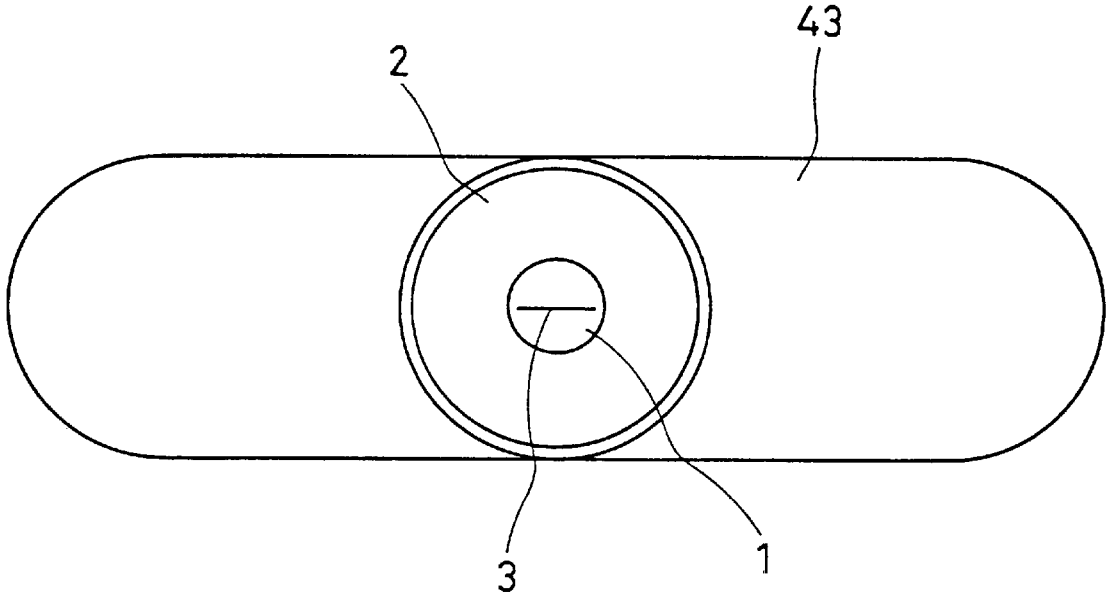
FIG. 10 is a plan view showing a liquid communication adapter according to an embodiment of the present invention.
Figure 11:
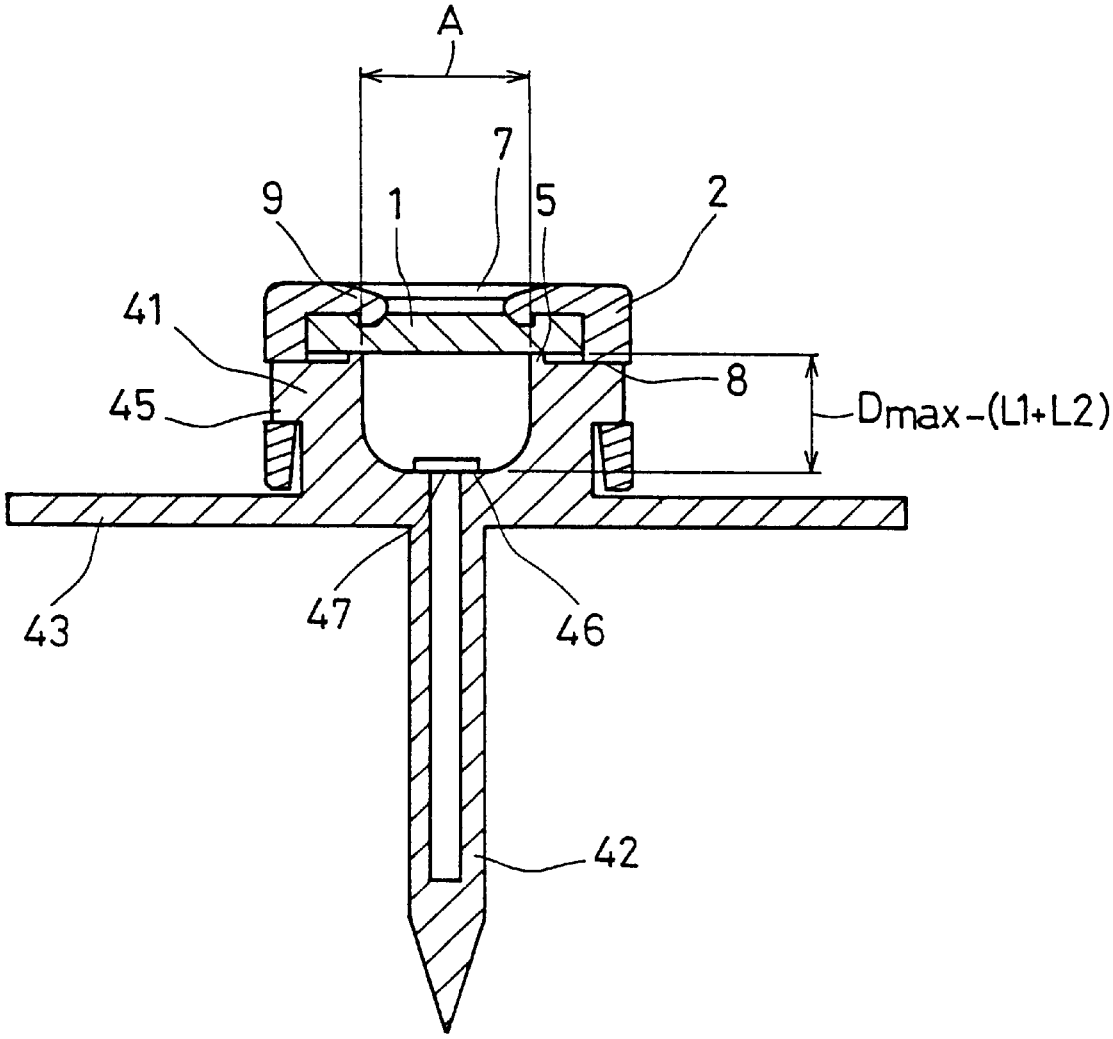
FIG. 11 is a sectional side view showing the liquid communication adapter according to an embodiment of the present invention.

The cover is not specifically limited as long as it firmly can hold (restrain) the valve in cooperation with the proximal end of the cannula as described below when the insertion member is inserted in/removed from the valve. For example, as shown in FIG. 10 or 11, when a cover 2 is formed so as to cover at least an upper periphery of a valve 1 with a central portion of a front surface of the valve 1 left uncovered (open), an insertion site for the insertion member easily can be found and the accidental contact can be prevented from contaminating the valve surface. It also is more effective to provide a front surface of the cover 2 with a gentle taper (inclination).

The cannula includes a portion piercing the stopper of the container and the proximal end opposite to the tip of the piercing portion. Although the piercing portion may be similar to the needle portion of the conventionally known spike and is not limited specifically, it is preferable that the tip thereof is closed so as not to cause coring and the side wall of the cannula has the opening. Also, the cannula may be bent at a predetermined site so as to draw liquid medicine thoroughly from a vial or the like to a syringe.

Although the profile of the proximal end of the cannula is not specifically limited as long as the proximal end restrains the valve in cooperation with the cover 2 and has a shape corresponding to that of the cover so as to function as such, the proximal end can have a cylindrical shape with a diameter larger than that of the piercing portion of the cannula. In FIG. 11, under the cover 2 or the valve 1, a proximal end 41 of the cannula preferably has a seating 8 for supporting a lower periphery of the valve 1 with a central portion of a back surface thereof left free. This makes it possible to restrain the valve 1 reliably by the upper and lower peripheries within the liquid communication adapter.

When an annular rib 5 is formed annularly along a periphery of a hole provided in the seating 8 as shown in FIG. 11, liquid leakage between the valve 1 and the seating 8 can be prevented even with deformation of the valve 1 because of the insertion of the insertion member into the liquid communication adapter. The material for the cannula can be metal such as stainless steel or a synthetic resin such as an ABS resin, polycarbonate and polypropylene, but preferably is the synthetic resin that allows the piercing portion and the proximal end to be molded into one piece easily. When considering heat resistance and chemical resistance, the material therefor preferably is polyacetal, polypropylene, polyamide, polyethylene terephthalate, polybutylene terephthalate or polycarbonate.

The anchor means is not specifically limited as long as it has a simple structure so as to anchor the insertion member such as the syringe luer to the liquid communication adapter. For example, it can be a round fitting hole 7 formed at the center of the cover 2, which is formed to have a shape and dimension allowing the fitting hole 7 to fit the insertion member such as the luer engageably. Such a configuration makes it possible to anchor the insertion member reliably with a simple structure.

When the insertion member is a syringe tip having a general luer shape, it is preferable that the dimension of the fitting hole 7 is 3.9 to 4.4 mm in diameter and 0.3 to 1.0 mm in thickness. It also is preferable that the cover 2 is strong enough not to crack even when fitting the insertion member firmly into the fitting hole 7. When considering chemical resistance and heat resistance, the material therefor can be polyacetal, polypropylene, polyamide, polyethylene terephthalate, polybutylene terephthalate or polycarbonate.

The valve 1 is appropriate as long as it allows easy insertion and removal of the insertion member and can be opened reliably. For example, it can be a disk valve 1 having a flat surface. If the disk valve 1 has a bowl-shaped surface, the insertion member can be inserted easily and cannot be removed accidentally. Furthermore, there is an advantage that the liquid leakage from the insertion hole can be suppressed when the insertion member is removed. However, there is a practical disadvantage that a liquid remains on the disk valve 1 and that the remaining liquid is difficult to wipe off.

Moreover, a circular or an elliptical profile of the valve 1 is appropriate for molding the liquid communication adapter. It is convenient when an insertion hole 3 of the valve 1 is formed to be a linear slit. When the insertion member has a luer shape of the general syringe as described above, it is preferable that the length L0 of the slit is 2.5 to 4.5 mm from the viewpoint of insertion characteristics of the valve and liquid tightness.

It also is preferable that the ratio of an outer diameter D2 of the valve 1 to the length L0 of the slit is $1.1 \leqq D2/L0$ for the reason described below. It is preferable that the valve 1 has a thickness of 1 to 2 mm from the viewpoint of the insertion characteristics and non-return effect of the valve and cost effectiveness. The material for the valve 1 may be any rubber-like elastic materials, and more specifically, it preferably is the one having a JIS-A hardness of 20 to 55. The specific material can be a silicone rubber, a natural rubber, a synthetic rubber such as a butyl rubber and a nitrile rubber, or a thermoplastic elastomer.

The following is a description of a liquid communication adapter according to an embodiment of the present invention, with reference to the accompanying drawings. FIGS. 10 to 12 illustrate the liquid communication adapter according to an embodiment of the present invention. In FIGS. 10 to 12, numeral 1 denotes a disk valve, numeral 2 denotes a cover, numeral 3 denotes an insertion hole, numeral 42 denotes a piercing portion of a cannula, numeral 41 denotes a proximal end of the cannula, and numeral 43 denotes a gripping means (a flange).

Since the valve 1 itself is similar to that shown in FIG. 3, a detailed description thereof is omitted here.

The insertion hole 3 also has a slit-like shape consisting of one straight line. However, it is not specifically limited to the above shape, but may have a slit-like shape consisting of, for example, three straight lines crossing at the center.

Figure 13:
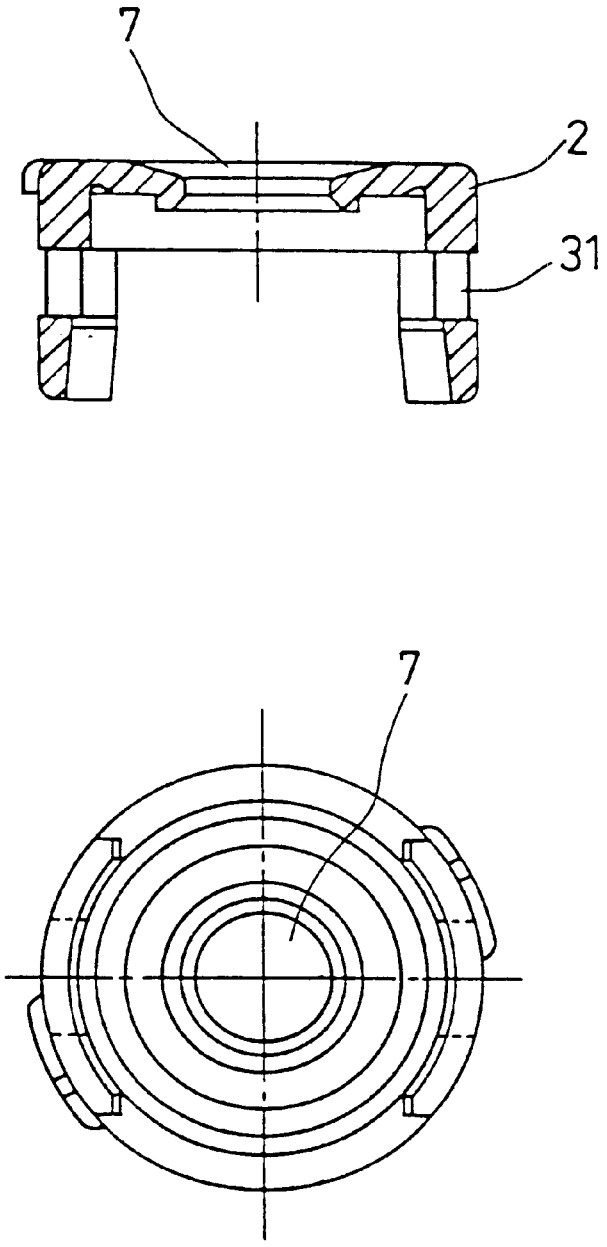
FIG. 13A is a sectional side view showing a cover in the liquid communication adapter according to an embodiment of the present invention.
FIG. 13B is a bottom view showing the cover in the liquid communication adapter according to an embodiment of the present invention.

As shown in FIG. 13, the cover 2 has a fitting hole 7 at the center and a gentle taper (inclination) toward the fitting hole 7. In order to allow fastening in an outer periphery, an outer side portion of the cover 2 is provided with at least two notches 31, which engage with protrusions 45 provided on a side of the proximal end of the cannula as shown in FIG. 11.

Furthermore, although the circumference of the cover 2 is circular in FIG. 13, it also may be elliptical as the valve shape, or polygonal.

By covering and restraining the periphery and the upper periphery of the valve 1 with the cover 2 with the central portion thereof left uncovered, it is possible to reduce a surface area of the insertion hole of the container mouth to be exposed. This can reduce considerably the chance of entry of impurities into liquid medicine in the container and infection with bacteria floating in the outside air.

Moreover, this cover 2 firmly can hold the insertion member in the liquid communication adapter. For example, in the central portion of the cover, the insertion member can be fitted and held firmly in the circular fitting hole 7 that has a diameter equal to or slightly smaller than that of the insertion member. When medicine is prepared by filling a solvent into a vacuum vial containing a powder preparation, a syringe can be left standing because it is supported upright by the fitting hole 7 and does not lean. While left standing, the solvent in the syringe is drawn into the vial by a negative pressure therein, and therefore, it is possible to prepare a plurality of medicines in the meantime.

The fitting hole 7 preferably has a diameter of 3.9 to 4.4 mm and a thickness of 0.3 to 1.0 mm so as to correspond to a standard luer, and it more preferably has a diameter of 3.9 to 4.2 mm and a thickness of 0.5 to 0.7 mm. Also, the fitting hole 7 may be tapered so as to correspond to a tapered luer of the above-described insertion member.

The material for the cover 2 has to have a hardness suitable for holding the valve 1 and the insertion member tightly. In particular, the cover 2 desirably has a suitable hardness and is formed of a material that is not easily damaged so that the insertion member easily can be inserted into the fitting hole 7 (an excessive hardness reduces tolerance for receiving the insertion member) and fitted securely. For example, polyamide, polyethylene terephthalate, polybutylene terephthalate and polycarbonate are desirable in addition to polyacetal and polypropylene.

When D1 represents a diameter of the fitting hole 7, D2 represents an outer diameter of the disk valve 1, and L0 represents a length of the slit of the insertion hole 3, these values preferably satisfy the relationship of $1.1 \leqq D2/L0$ as in FIG. 6. As in FIG. 6, this is because, if the length L0 of the insertion hole is larger than the outer diameter D2 of the valve, namely, D2/L0 is smaller than 1.1, the insertion into the valve may cause valve deformation or damage (breakage) or reduce the outer portion of the valve with respect to the annular rib 5, so that the valve falls off from the seating at the time of the insertion.

Regarding the length L0 of the slit serving as the insertion hole and the insertion member, when the insertion member is inserted into the slit, the diameter of the insertion member that is buried into the valve 1 is called an inserted portion diameter here. In this case, it is preferable that the slit length L0 is 0.5 to 1.1 times as large as the inserted portion diameter. This is because the insertion of the insertion member is difficult when L0 is shorter, while the insertion of the insertion member into the liquid communication adapter is more likely to cause liquid leakage from the insertion hole when L0 is larger.

Furthermore, the diameter A inside a seating 8 preferably is small from the viewpoint of resealing, but has to be large enough to receive the insertion member until the insertion member is anchored tightly by the fitting hole 7. In other words, it has to be larger than the diameter of the insertion member itself and large enough to secure a space in which the valve 1 can yield downward to a pressure. When the insertion member is the syringe luer, the diameter A inside the seating 8 preferably is 5.0 to 7.0 mm.

Figure 14:
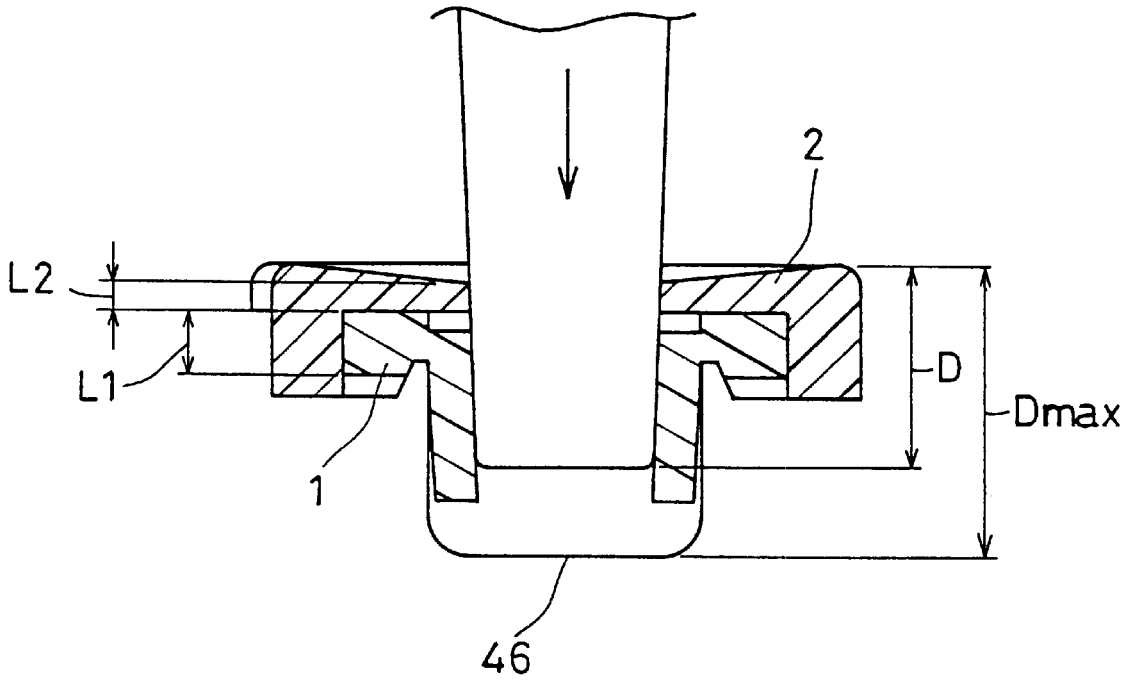
FIG. 14 is a drawing for describing a state when inserting an insertion member in the liquid communication adapter according to an embodiment of the present invention.

Moreover, when an inserted depth of the insertion member such as the syringe luer is expressed by D as shown in FIG. 14, a maximum value of the inserted depth $D_{max}$ is a depth to a bottom 46 of the proximal end of the cannula. In this case, in order that a liquid not only can be filled in but also drawn from a vial, the liquid communication adapter according to an embodiment of the present invention has to satisfy the relationship of $(L1+L2) \leqq D \leqq D_{max}$ in relation to the valve thickness L1 and the fitting hole thickness L2.

The bottom 46 of the proximal end of the cannula may be provided with a filter 47. In this case, the maximum value $D_{max}$ of the inserted depth is a depth to an upper surface of the filter 47. It is preferable that $D_{max}-(L1+L2)$ is 3.0 to 6.0 mm. This is because this value indicates the depth suitable for fixing the luer and preventing the luer from being inserted excessively.

In addition, when the proximal end 41 of the cannula is provided with the seating 8 for supporting the lower periphery of the valve with the central portion of the back surface thereof left free as shown in FIG. 11, the valve 1 can be restrained firmly by the liquid communication adapter main body. The seating 8 is formed annularly so as to correspond to the valve shape.

Also, the cover 2 is provided with an annular hook, which engages with the annular groove formed on the front surface of the valve 1 in an inner portion with respect to the periphery of the valve on the seating 8, thereby preventing liquid medicine, which may leak from the slit at the time of removing the insertion member, from accumulating in the annular groove even when the insertion of the insertion member into the container cap has deformed the valve 1.

As shown in FIGS. 11 and 12, the piercing portion 42 of the cannula is a hollow cylinder with a closed tip and its side surface is provided with an opening 44 in communication with the inside of the container. Since the opening 44 is provided in the side wall of the cannula, it is possible to prevent coring. The piercing portion 42 of the cannula and the proximal end 41 of the cannula preferably are made of a synthetic resin that is molded as one piece, and this synthetic resin preferably is polyacetal, polypropylene, polyamide, polyethylene terephthalate, polybutylene terephthalate or polycarbonate from the viewpoint of heat resistance and chemical resistance.

Furthermore, as shown in FIGS. 10 to 11, it is preferable that a symmetrically extending plate-like flange 43 is formed in any portion between the piercing portion 42 of the cannula and the proximal end 41 thereof The flange 43 serves as a sufficient gripping space at the time of an attachment to the container, making it easier to attach the adapter to the container while preventing an accidental contact with a hand or the like from contaminating the valve surface. Although the flange 43 is molded into one piece with the cannula in the present embodiment, it may be molded into one piece with the cover 2 or formed by adhering another member with an adhesive or the like.

Figure 12C:
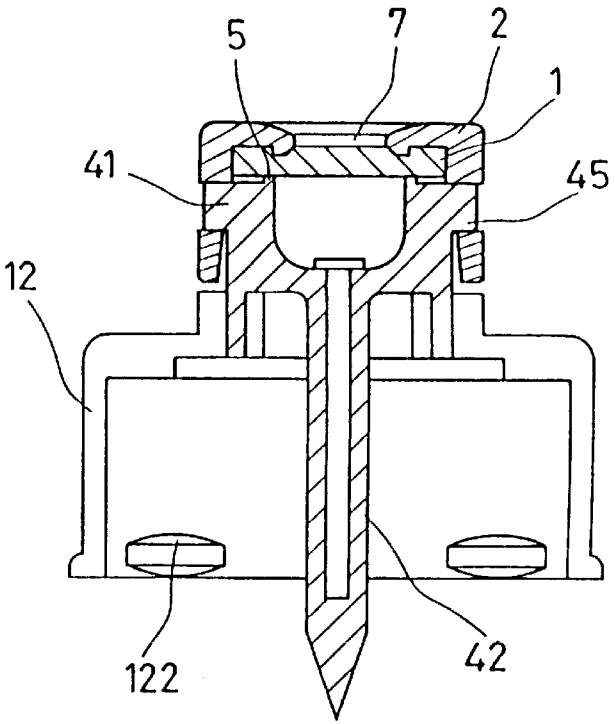
FIG. 12C is a sectional side view showing the liquid communication adapter according to an embodiment of the present invention.
Figure 12B:
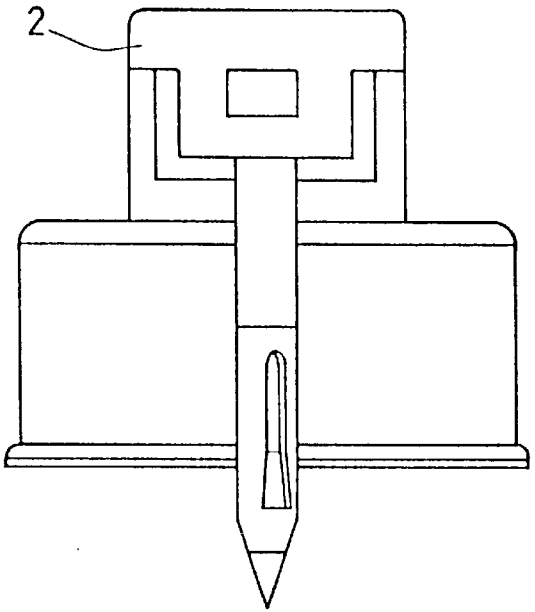
FIG. 12B is a front view showing the liquid communication adapter according to an embodiment of the present invention.
Figure 12A:
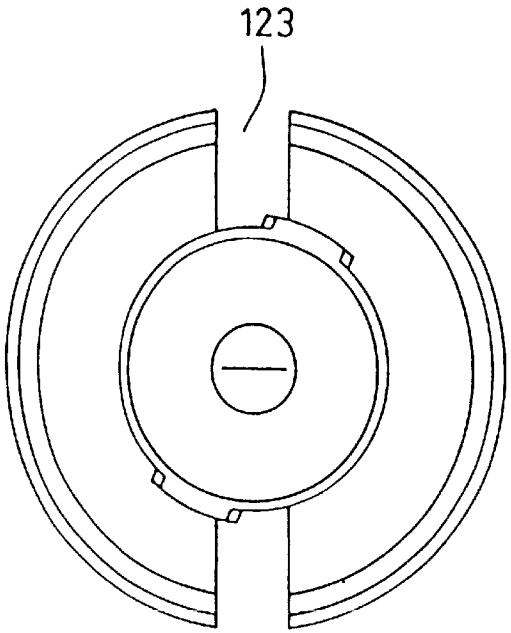
FIG. 12A is a plan view showing the liquid communication adapter according to an embodiment of the present invention.

Furthermore, as shown in FIGS. 12A to 12C, it is preferable that a collar member 12 for covering the container mouth partially or entirely and engaging with the container is formed in any portion between the piercing portion 42 of the cannula and the proximal end 41 thereof. FIG. 12A is a plan view showing the liquid communication adapter according to an embodiment of the present invention. FIG. 12B is a front view showing the liquid communication adapter according to an embodiment of the present invention. FIG. 12C is a sectional side view showing the liquid communication adapter according to an embodiment of the present invention.

As shown in FIGS. 12A to 12C, in order to fasten the liquid communication adapter to the container mouth reliably, the inner surface of the side portion of the collar member 12 is provided with at least two protrusions 22 so as to engage with the container mouth of the conventional container (for example, a vial). Furthermore, it is desirable that at least one notch 123 is provided in order to fasten the liquid communication adapter to the container mouth easily.

As in the case of the container cap, it is effective to use the lock adapter as shown in FIG. 7 in order to anchor the insertion member more reliably.

Figure 15A:
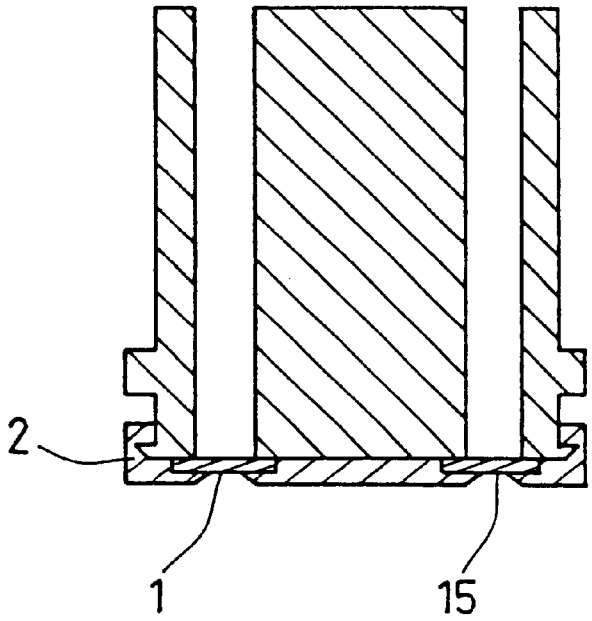
FIG. 15A is a sectional side view of a container cap or a liquid communication adapter according to an example of the present invention.
Figure 15B:
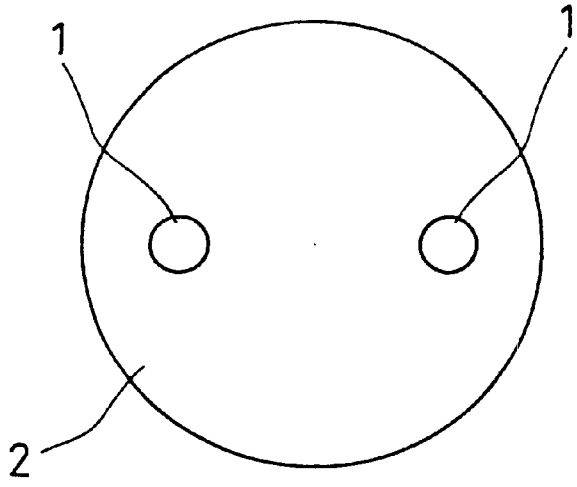
FIG. 15B is a bottom view of the container cap or the liquid communication adapter according to an example of the present invention.

In the above description, the valve 1 has been located at the center of the container cap or the liquid communication adapter. However, the valve 1 is not required to be located at the center of the container cap or the liquid communication adapter. That is, the valve 1 may be arranged at a position different from the center of the cover 2 as shown in FIG. 15. In this case, a rubber-like elastic member portion 15, which is a conventional stopper, can be provided, making it possible to secure a piercing portion for an infusion set or the like.

Figure 16A:
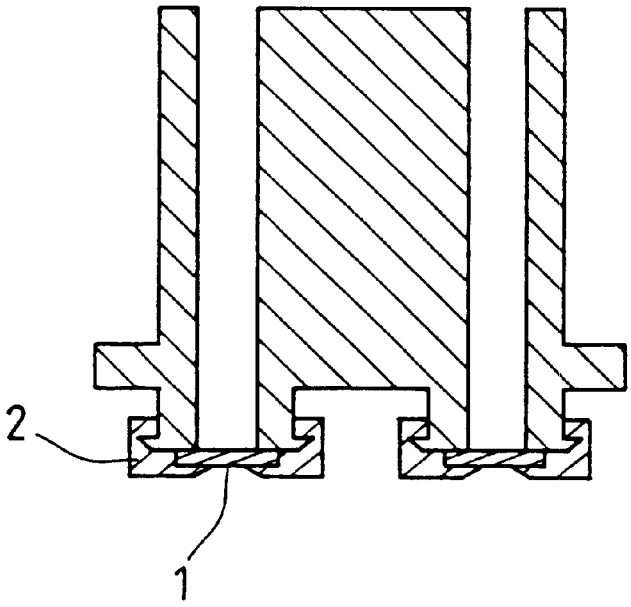
FIG. 16A is a sectional side view of a container cap or a liquid communication adapter according to another example of the present invention.
Figure 16B:
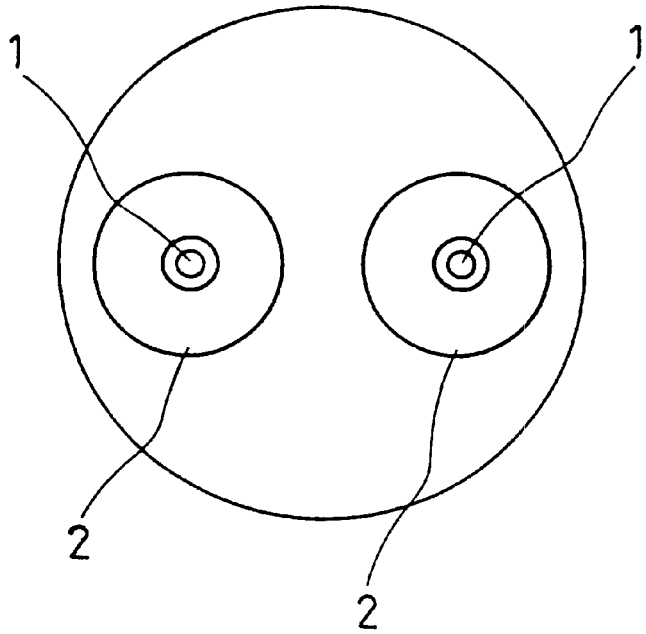
FIG. 16B is a bottom view of the container cap or the liquid communication adapter according to an example of the present invention.

Alternatively, not one but two valves 1 can be provided. In other words, as shown in FIG. 16, by providing two valves 1, it becomes possible to use an infusion set or the like without using a sharp needle.

In addition, the valve 1 and the rubber-like elastic member portion 15 or a plurality of the valves may be, for example, physically separated, or the valve 1 and the rubber-like elastic member portion 15 may be provided on the same surface of a rubber member having substantially the same shape as the profile of the container cap.

Industrial Applicability

As described above, with the container cap or the liquid communication adapter according to the present invention, a commonly used syringe can be used, and air-tightness and liquid tightness with the luer of the syringe reliably can be kept when the luer is connected while liquid leakage reliably can be prevented when the luer is not connected.

Also, the syringe luer can be engaged, and therefore, when medicine is prepared by filling a solvent into a vacuum vial containing a powder preparation, for example, the syringe can be left standing because it is supported upright and does not lean. While left standing, the solvent in the syringe is drawn into the vial by a negative pressure therein, and therefore, it is possible to prepare a plurality of medicines in the meantime.

Since a solution or liquid medicine can be drawn from the container, when drawing the liquid medicine into the syringe and then mixing/introducing this liquid medicine into a blood circuit or an infusion or blood transfusion set to which a three-way valve or a mixing/introducing port capable of receiving an insertion member such as a commonly used syringe luer is attached, it is possible to perform a series of operations without using a sharp needle at all. In other words, the needle used for drawing up the liquid medicine etc. becomes unnecessary, thus reducing costs. Also, because the needle does not need to be attached/removed before the mixing/introducing, the operation is simplified. Furthermore, there is no problem of accidental pricks, which have accompanied the needle being attached to/removed from the syringe.

In addition, it is possible to carry out operations such as drawing up and introducing the liquid medicine and preparing medicine without using the sharp needle, and thus, even many repeated piercings do not cause degradation in a rubber-like stopper of the vial, thus reducing a possibility of liquid medicine contamination because of coring.

What is claimed is:

1. A container cap comprising:

at least one disk-like valve provided with an insertion hole in a central portion thereof; and a cover for restraining the valve by covering at least an upper periphery of the valve;

wherein a lower periphery on a back surface of the valve is supported by a seating portion of a joint that is supported by the container mouth, and the container cap has an anchor means for anchoring an insertion member to the cap by using a peripheral edge forming a fitting hole in the cover, when inserting the insertion member into the insertion hole.

2. The container cap according to claim 1, wherein the joint has a supported portion that is supported by the container mouth.

3. The container cap according to claim 1, having an anchor means to the container mouth on an inner surface at a lower end of a side portion of the cover.

4. The container cap according to claim 3, having at least one notch in the side portion of the cover.

5. The container cap according to claim 1, wherein the cover has at least two leg portions, whose lower ends are provided with an anchor means to the container mouth.

6. The container cap according to claim 1, further comprising an annular rib that is formed annularly along an upper peripheral edge of the joint forming a hole provided in the joint.

7. The container cap according to claim 1, further comprising an 0-ring between the joint and the container mouth.

8. The container cap according to claim 1, wherein the anchor means is a circular fitting hole formed at a center of the cover and anchors the insertion member by the peripheral edge forming the fitting hole in the cover.

9. The container cap according to claim 8, wherein the fitting hole has a diameter of 3.9 to 4.4 mm, and the cover forming the fitting hole has a thickness of 0.3 to 1.0 mm in a portion contacting the insertion member.

10. The container cap according to claim 1, wherein an annular groove is formed on a front surface of the disk-like valve.

11. The container cap according to claim 10, wherein an annular hook engaging with the annular groove formed on the front surface of the disk-like valve is formed in a restraining portion of the cover.

12. The container cap according to claim 1, wherein the insertion hole is a linear slit having a length L0 of 2.5 to 4.5 mm.

13. The container cap according to claim 1, wherein the insertion hole is a linear slit having a length L0 of 3.0 to 4.0 mm.

14. The container cap according to claim 12, wherein a ratio of an outer diameter D2 of the valve to the length L0 of the slit is $1.1 \leqq D2/L0$.

15. The container cap according to claim 13, wherein a ratio of an outer diameter D2 of the valve to the length L0 of the slit $1.1 \leqq D2/L0$.

16. The container cap according to claim 1, wherein the valve has a thickness of 1.0 to 2.0 mm.

17. The container cap according to claim 1, wherein the valve has a thickness of 1.0 to 2.0 mm in a portion of the insertion hole.

18. The container cap according to claim 16, wherein the valve is formed of an elastic material having a JIS-A hardness of 20 to 55.

19. The container cap according to claim 16, wherein a material for the valve is selected from the group consisting of a silicone rubber; a natural rubber; a synthetic rubber and a thermoplastic elastomer.

20. The container cap according to claim 1, wherein at least two protrusions are provided in a periphery of a side surface of the cover; and the container cap has an anchor means for anchoring the insertion member by a cylindrical lock adapter whose bottom is provided with notches engaging with the protrusions, that has the insertion member inserted and restrained therethrough and inserts the insertion member into the insertion hole and rotates the bottom, thereby engaging the notches provided at the bottom with the protrusions of the cover.

21. A liquid communication adapter at least comprising:

a cannula piercing a stopper of a container; and at least one disk-like valve placed at a proximal end of the cannula and provided with an insertion hole in a central portion thereof;

wherein an insertion member extending inward through the valve and the container are in a liquid communication with each other, the liquid communication adapter comprises a seating for supporting a lower periphery on a back surface of the valve, and a cover for restraining the valve covering at least an upper periphery of the valve, and has an anchor means for anchoring the insertion member to the adapter by using a peripheral edge forming a fitting hole in the cover; when inserting the insertion member into the insertion hole.

22. The liquid communication adapter according to claim 21, wherein at least two protrusions are formed on a side surface of the proximal end of the cannula, and at least two notches engaging with the protrusions are formed on the cover.

23. The liquid communication adapter according to claim 21, further comprising an annular rib that is formed annularly along an upper peripheral edge of the seating forming a hole provided in the seating.

24. The liquid communication adapter according to claim 21, wherein the anchor means is a circular fitting hole formed at a center of the cover and anchors the insertion member by the periheral edge forming the fitting hole in the cover.

25. The liquid communication adapter according to claim 21, wherein a filter is provided in a lower portion of the seating.

26. The liquid communication adapter according to claim 21, wherein the fitting hole has a diameter of 3.9 to 4.4 mm, and the cover forming the fitting hole has a thickness of 0.3 to 1.0 mm in a portion contacting the insertion member.

27. The liquid communication adapter according to claim 21, wherein an annular groove is formed on a front surface of the disk-like valve.

28. The liquid communication adapter according to claim 27, wherein an annular hook engaging with the annular groove formed on the front surface of the disk-like valve is formed in a restraining portion of the cover.

29. The liquid communication adapter according to claim 21, insertion hole is a linear slit having a length L0 of 2.5 to 4.5 mm.

30. The liquid communication adapter according to claim 21, insertion hole is a linear slit having a length L0 of 3.0 to 4.0 mm.

31. The liquid communication adapter according to claim 30, wherein a ratio of an outer diameter D2 of the valve to the length L0 of the slit is $1.1 \leqq D2/L0$.

32. The liquid communication adapter according to claim 21, wherein the valve has a thickness of 1.0 to 2.0 mm.

33. The liquid communication adapter according to claim 21, wherein the valve has a thickness of 1.0 to 2.0 mm in a portion of the insertion hole.

34. The liquid communication adapter according to claim 31, wherein the valve is formed of an elastic material having a JIS-A hardness of 20 to 55.

35. The liquid communication adapter according to claim 21, wherein the insertion member is fitted through the valve, a maximum inserted depth $D_{max}$, an inserted depth D, a valve thickness L1 and a thickness L2 in a portion contacting the insertion member in the cover forming the fitting hole satisfy a relationship of $(L1+L2) \leqq D \leqq_{max}$.

36. The liquid communication adapter according to claim 34, wherein a material for the valve is selected from the group consisting of a silicone rubber, a natural rubber, a synthetic rubber and a thermoplastic elastomer.

37. The liquid communication adapter according to claim 21, wherein at least two protrusions are provided in a periphery of a side surface of the cover; and the liquid communication adapter has an anchor means for anchoring the insertion member by a cylindrical lock adapter whose bottom is provided with notches engaging with the protrusions, that has the insertion member inserted and restrained therethrough and inserts the insertion member into the insertion hole and rotates the bottom, thereby engaging the notches provided at the bottom with the protrusions of the cover.

38. A container cap comprising:

at least one disk-like valve provided with an insertion hole in a central portion thereof; and a cover for restraining the valve by covering at least an upper periphery of the valve;

wherein a lower periphery on a back surface of the valve is supported by-a seating portion of a container mouth, and the container cap has an anchor means for anchoring an insertion member to the cap by using a peripheral edge forming a fitting hole in the cover, when inserting the insertion member into the insertion hole.

39. The container cap according to claim 38, having an anchor means to the container mouth on an inner surface at a lower end of a side portion of the cover.

40. The container cap according to claim 39, having at least one notch in the side portion of the cover.

41. The container cap according to claim 38, wherein the cover has at least two leg portions, whose lower ends are provided with an anchor means to the container mouth.

42. The container cap according to claim 38, wherein the anchor means is a circular fitting hole formed at a center of the cover and anchors the insertion member by the peripheral edge forming the fitting hole in the cover.

43. The container cap according to claim 42, wherein the fitting hole has a diameter of 3.9 to 4.4 mm, and the cover forming the fitting hole has a thickness of 0.3 to 1.0 mm in a portion contacting the insertion member.

44. The container cap according to claim 38, wherein an annular groove is formed on a front surface of the disk-like valve.

45. The container cap according to claim 44, wherein an annular hook engaging with the annular groove formed on the front surface of the disk-like valve is formed in a restraining portion of the cover.

46. The container cap according to claim 38, wherein the insertion hole is a linear slit having a length L0 of 2.5 to 4.5 mm.

47. The container cap according to claim 38, wherein the insertion hole is a linear slit having a length L0 of 3.0 to 4.0 mm.

48. The container cap according to claim 46, wherein a ratio of an outer diameter D2 of the valve to the length L0 of the slit is $1.1 \leqq D2/L0$.

49. The container cap according to claim 47, wherein a ratio of an outer diameter D2 of the valve to the length L0 of the slit $1.1 \leqq D2/L0$.

50. The container cap according to claim 38, wherein the valve has a thickness of 1.0 to 2.0 mm.

51. The container cap according to claim 38, wherein the valve has a thickness of 1.0 to 2.0 mm in a portion of the insertion hole.

52. The container cap according to claim 50, wherein the valve is formed of an elastic material having a JIS-A hardness of 20 to 55.

53. The container cap according to claim 50, wherein a material for the valve is selected from the group consisting of a silicone rubber; a natural rubber; a synthetic rubber and a thermoplastic elastomer.

54. The container cap according to claim 38, wherein at least two protrusions are provided in a periphery of a side surface of the cover; and the container cap has an anchor means for anchoring the insertion member by a cylindrical lock adapter whose bottom is provided with notches engaging with the protrusions, that has the insertion member inserted and restrained therethrough and inserts the insertion member into the insertion hole and rotates the bottom, thereby engaging the notches provided at the bottom with the protrusions of the cover.

* * * * *

UNITED STATES PATENT AND TRADEMARK OFFICE

CERTIFICATE OF CORRECTION

PATENT NO. : 6,568,439 B1
DATED : May 27, 2003
INVENTOR(S) : Se et al.

It is certified that error appears in the above-identified patent and that said Letters Patent is hereby corrected as shown below:

Column 2,
Line 4, "the rubber-like stopper ark, using a metal" should read -- the rubber-like stopper using a metal --

Column 11,
Line 20, "on the front surface thereof Since it is" should read -- on the front surface thereof. Since it is --

Column 13,
Lines 14-15, "elastic material, and more CM specifically," should read -- elastic material, and more specifically, --

Column 21,
Line 30, "$(L1+L2) \leqq D \leqq_{max}$" should read -- $(L1+L2) \leqq D_{max}$ --

Lines 52-53, "the valve is supported by-a seating portion of a container" should read -- the valve is supported by a seating portion of a container --

Column 22,
Lines 33-34, "the length L0 of the slit $1.1 \leqq D2/L0$" should read -- the length L0 of the slit is $1.1 \leqq D2/L0$ --

Signed and Sealed this

Sixteenth Day of March, 2004

JON W. DUDAS
*Acting Director of the United States Patent and Trademark Office*